US012075900B2

(12) United States Patent
Del Din et al.

(10) Patent No.: US 12,075,900 B2
(45) Date of Patent: Sep. 3, 2024

(54) CONTAINER WITH INTERNAL GLASS RECEPTACLE AND METHOD FOR ASSEMBLING THE CONTAINER BY USING A SPACING AND LOCKING INSERT

(71) Applicant: Pochet Du Courval, Clichy (FR)

(72) Inventors: Antoine Del Din, Yaucourt-Bussus (FR); Frédéric Jouan, Moriers (FR); Bruno Godard, Allery (FR)

(73) Assignee: POCHET DU COURVAL, Clichy (FR)

( * ) Notice: Subject to any disclaimer, the term of this patent is extended or adjusted under 35 U.S.C. 154(b) by 188 days.

(21) Appl. No.: 17/703,735

(22) Filed: Mar. 24, 2022

(65) Prior Publication Data

US 2022/0211161 A1 Jul. 7, 2022

Related U.S. Application Data

(63) Continuation-in-part of application No. PCT/EP2020/076491, filed on Sep. 23, 2020.

(30) Foreign Application Priority Data

Sep. 25, 2019 (FR) ..... 1910595

(51) Int. Cl.
*A45D 40/00* (2006.01)
*A45D 34/00* (2006.01)
(Continued)

(52) U.S. Cl.
CPC ..... *A45D 40/0068* (2013.01); *A45D 34/00* (2013.01); *B65D 51/18* (2013.01);
(Continued)

(58) Field of Classification Search
CPC ..... A45D 2034/005; A45D 34/00; A45D 40/0068; A45D 40/18; B65D 2251/0015;
(Continued)

(56) References Cited

U.S. PATENT DOCUMENTS 5,938,016 A * 8/1999 Erdtmann ..... A45D 40/0068 220/495.08
9,861,177 B2 1/2018 Lefevre et al.
(Continued)

FOREIGN PATENT DOCUMENTS

FR 1 263 403 6/1961
FR 1 573 885 7/1969
(Continued)

OTHER PUBLICATIONS

International Search Report for PCT/EP2020/076491 dated Nov. 27, 2020, 4 pages.
Written Opinion of the ISA for PCT/EP2020/076491, dated Nov. 27, 2020, 8 pages.

*Primary Examiner* — Nathan J Jenness
*Assistant Examiner* — Madison L Poos
(74) *Attorney, Agent, or Firm* — NIXON & VANDERHYE

(57) ABSTRACT

The container for containing a product, typically cosmetic, has an internal receptacle mounted in an external covering receptacle, by using an adapter insert. The receptacles are made of glass and an attachment region is provided internally on the internal receptacle, near its annular upper end, in order to secure the latter to the insert. The insert is provided with an insertion portion received internally within the external receptacle, a first locking unit and second locking unit. The first locking unit, formed in an elastically deformable portion separated from the rest of the insertion portion by slots are opposing the rotation of the insert around the internal receptacle, while the second locking unit is opposing the rotation of the external receptacle around the insert by engaging on a neck of the external receptacle.

16 Claims, 14 Drawing Sheets

(51) Int. Cl.
*B65D 51/18* (2006.01)
*B65D 77/04* (2006.01)

(52) U.S. Cl.
CPC .... *B65D 77/0493* (2013.01); *A45D 2034/005* (2013.01); *B65D 2251/0015* (2013.01); *B65D 2251/0093* (2013.01)

(58) Field of Classification Search
CPC .... B65D 2251/0018; B65D 2251/0093; B65D 41/04; B65D 51/18; B65D 77/0493
USPC ..... 215/6
See application file for complete search history.

(56) References Cited

U.S. PATENT DOCUMENTS

| | | | | |
|---|---|---|---|---|
| 9,944,444 | B2 | 4/2018 | Presche | |
| 10,829,271 | B1 * | 11/2020 | Bulla | B65D 43/0231 |
| 11,760,551 | B2 * | 9/2023 | Fava | B65D 43/0231 220/23.87 |
| 2020/0197965 | A1 | 6/2020 | Delmon et al. | |
| 2020/0275759 | A1 * | 9/2020 | Chevalier | A45D 40/0068 |

FOREIGN PATENT DOCUMENTS

| | | |
|---|---|---|
| FR | 2 878 835 | 6/2006 |
| FR | 3 060 271 | 6/2018 |
| FR | 3 071 388 | 3/2019 |

* cited by examiner

CONTAINER WITH INTERNAL GLASS RECEPTACLE AND METHOD FOR ASSEMBLING THE CONTAINER BY USING A SPACING AND LOCKING INSERT

CROSS REFERENCE TO RELATED APPLICATION

This application is a Continuation-In-Part application of the International Application No. PCT/EP2020/076491 filed Sep. 23, 2020, which in turn claims priority to FR Patent Application No. 1910595 filed Sep. 25, 2019, the entire contents of which are hereby incorporated by reference.

BACKGROUND OF THE INVENTION

Field of the Invention

This invention relates to the field of packaging containers enabling good preservation of a product, in particular a cosmetic or perfumery product, and more particularly the field of glass containers.

The invention relates here to a container which has an internal receptacle serving to contain the product (for example cosmetic or similar type) directly, and an external glass receptacle which allows housing the internal receptacle internally, this external receptacle combining the functions of decoratively covering the container and of receiving a lid that can be used to seal the container after the consumer has used the product for the first time. The invention also relates to a method of assembling the container by using an adapter insert (ring) which makes it possible to maintain space between the internal receptacle and the external receptacle.

Description of the Related Art

It has long been known, as illustrated for example by document FR 1573885, to use decorative external glass coverings in cosmetic product packaging devices, while receiving the product in an internal receptacle, typically made of plastic. However, the use of an internal receptacle made of plastic can pose problems of chemical compatibility with the product to be packaged. Polyethylene and polypropylene are then the only choices for producing such an internal receptacle. There is therefore a need to improve the chemical compatibility of the internal receptacle with the product, improving the preservation of the latter, and to limit the use of disposable plastic receptacles.

In addition, it would be of particular interest to be able to refill the receptacle with product easily, typically without throwing away a plastic container and while minimizing the amount of plastic for creating the interface between receptacles.

From document FR 2878835 A1, interfaces are known for assembling an internal receptacle which may be made of glass with a decorative receptacle covered on the inside with a lining, in order to obtain a dispensing assembly for fluid product which allows refills. However, the type of assembly shown in that document is relatively complex, which limits its application and reduces the possibilities for aesthetic effects (inability to take full advantage of the properties and performance of glass). Documents FR 3060271 A1 and FR 3071388 A1 describe a mode of robust locking of an internal receptacle forming a removable refill, compatible with discreet and aesthetic integration of a ring connector. The attachment of the internal receptacle by elastic interlocking is associated with a pierced structure at the bottom of the external receptacle. Indeed, a lower opening is required for insertion of a finger in order to push on the internal receptacle from below to unlock it, which then allows the unlocked internal receptacle to be removed completely from the external receptacle.

In the field of glass bottles or receptacles, typically for applications far outside the cosmetics field, rubber/elastomer seals (compressible seals) are sometimes used to allow a reservoir to be fitted inside the external glass receptacle, as is shown for example in document U.S. Pat. No. 9,944,444 B2. A compressible seal of this type allows coming into direct contact with the glass wall of the external receptacle.

However, the use of rubber or elastomer is not very suitable for supporting an internal reservoir, particularly if one wishes to contain a relatively large amount of product while the internal receptacle is to be suspended. In addition, elastomer seals of this type are difficult to recycle (thermosetting plastics have crosslinks). It should also be noted that the use of polyethylene or polypropylene or similar plastics, as a substitute for an elastomer seal/insert for contact under pressure, is clearly unsuitable given the tendency of these polyolefins to crack (a phenomenon known as stress cracking). There is therefore a need for a robust container, obtained by an assembly solution that is optimized for the properties and performance of glass.

SUMMARY OF THE INVENTION

In order to improve the situation, a container is proposed for containing a product, typically cosmetic, formed by mounting, along a longitudinal axis, an internal receptacle within an external receptacle (receptacle which may constitute the decorative covering), preferably transparent, by means of an annular coupling insert, the container comprising:

- the internal receptacle, made of glass, defining a volume for receiving the product and extending between a bottom and an upper face provided with an opening bordered by an annular upper end of the internal receptacle;
- the external receptacle, made of glass, preferably transparent, suitable for housing the internal receptacle internally within an inside volume accessible through a longitudinal opening defined by a neck or lid-receiving member of the external receptacle; and
- the coupling insert, which consists for example of a ring of continuous annular section integral with the internal receptacle, the insert being suitable for directly supporting (preferably selectively) the annular upper end so as to create space between the internal receptacle and the external receptacle while maintaining the internal receptacle in a predetermined axial position relative to the external receptacle;

wherein an annular peripheral attachment region is provided on the internal receptacle, at said upper end or in a downwardly offset position adjacent to the upper end of the internal receptacle, so as to engage an inner engagement face of the annular insert with said attachment region and thus obtain a coupling state to immobilize the insert on the internal receptacle.

The external receptacle may be suitable for internally receiving an insertion portion of the insert which includes the inner engagement face,

- and with the feature that the insertion portion of the coupling insert has at least one elastically deformable portion which is:

suitable for engaging with the annular peripheral attachment region and locking the coupling state, and delimited/defined by slots or indentations within the thickness of the insertion portion.

According to the invention, it is possible to provide a container which can be aesthetically pleasing and capable of effectively preserving the contents while facilitating assembly. It also allows great flexibility in the final assembly, as the product may or may not already be present inside the internal receptacle and sealed, before insertion into the external receptacle.

Flexibility is also obtained in the choice of material of the annular insert, since the stresses exerted on this material can advantageously be minimized, on the one hand by forming elastically deformable portions defined between slots, on the other hand by being able to prevent contact between all or part of the insertion portion with the external receptacle. In preferred embodiments, the insertion portion is held radially distanced from the inner side face of the neck/receiving member that is part of the external receptacle. In other words, with this arrangement, the insert is well suited for immobilizing the receptacles (internal and external) relative to each other, without undergoing significant compression. Radial movement is allowed only at the deformable portions, in the knowledge that the complementary portions of the insertion portion are preferably more rigid in order to provide guidance and/or allow axial abutment against reliefs or a screw thread of the peripheral attachment region.

This makes it possible to lock a coupling state without wear to the material, for example by forming rigid regions, making it possible to attach the internal receptacle axially elsewhere than in the elastically deformable portion or portions. This also makes it possible to form a space (or several spacing areas) relative to the external receptacle, which makes it easy to mount the insert in the inner area defined by the neck or similar receiving member.

In preferred embodiments, relative rotation is required between the insert and the internal receptacle to achieve the coupling state. The internal receptacle and the insert can form a unit that is detachable from the external receptacle, the internal receptacle not being detachable from the insert until after the insert is detached, at an outer portion of the insert engaged with an attachment region formed laterally on the neck of the external receptacle (on an outer face of the neck, optionally by engaging under an outer edge or shoulder provided on this neck). In some options, the insert only extends inside the external receptacle, without any outer portion.

Advantageously, the coupling state of the annular insert around the internal receptacle may result from a relative rotation between the insert and the internal receptacle, preferably a screwing, to reach a locking configuration in which a lower portion of the insert constituting the insertion portion is rotationally locked at or under the annular upper end of the internal receptacle. In some embodiments, the insert has an outer portion including graspable engagement members. The coupling/rotational locking makes disassembly operations easy while preserving the integrity of the constituent material of the insert. The engagement members may be offset radially outwards relative to a top (upper portion of the external receptacle), which facilitates engagement of the insert at a distance from the axial opening of the internal receptacle.

In some embodiments, the internal receptacle has an upper flange to form its annular upper end, this upper flange extending around the opening (which is preferably the only opening of the internal receptacle). It is understood that the annular coupling insert can allow mounting from below, in order to come from below into an attachment position (the flange can form an axial stop) under the upper flange of the internal receptacle.

Typically, the insertion portion is substantially annular, the coupling insert comprising:

first rotation locking means (for example in the form of retaining lugs) capable of being attached on the peripheral annular attachment region, opposing the rotation of the insert around the internal receptacle in order to lock the coupling state, and each formed in the inner engagement face, in the at least one elastically deformable portion, each elastically deformable portion being separated from the rest of the insertion portion by slots, and second rotation locking means (for example in the form of retaining lugs/reliefs, possibly projecting opposite the lugs that are part of the elastically deformable portions) capable of being attached to the external receptacle in a locking configuration without interfering with the coupling state (coupling of insert—internal receptacle), opposing the rotation of the external receptacle around the insert.

In preferred options, the second locking means are formed in one or more regions of the insert which are separate from the elastically deformable portion(s). The second locking means may be configured to maintain an axial attachment position of the insert in which the insertion portion is inserted such that the internal receptacle is in the predetermined axial position (with spacing between the respective bottoms of the receptacles). This predetermined position is kept fixed when the coupling state and the locking configuration are obtained. It is understood that the inside volume can only be accessed through the upper longitudinal opening, which is an opening typically defined by a neck or lid-receiving member of the external receptacle.

The second rotation locking means may be actuated after having obtained the insert—internal receptacle coupling state, in order to lock a second coupling that is the insert—external receptacle coupling, with a maintaining of the predetermined axial position when this second coupling is locked. Each of the locks can be achieved without rotation of the receptacle (i.e. internal or external receptacle) to be secured to the insert, which means that:

for the first coupling, the internal receptacle can remain fixed along its longitudinal axis, the insert first being rotated in a first direction for the first coupling, then for finalizing the second coupling, the external receptacle can remain fixed along its longitudinal axis, the insert being able to rotate (thus resulting in a corresponding rotation of the internal receptacle) with respect to the external receptacle in a second direction of rotation which may be the same as or the reverse of the first direction.

The internal receptacle may optionally have already been sealed, before or after the first coupling, by means of a membrane seal adhering to the top of an outer portion of the insert and/or to an upper edge of the internal receptacle.

The external receptacle is advantageously suitable for storing and holding the internal receptacle while serving as an external decorative covering, with the possibility, where appropriate, of replacing only the internal receptacle and/or the insert after the content has been consumed. Rotational locking means the unlocking operation is easy and unlikely to damage the materials. The external receptacle can thus be reused. Moreover, it is also permitted to recycle and reuse the assembly formed by the insert and the internal receptacle, for example if the consumer is incentivized financially or in any other manner to return this assembly for the purpose of refilling the internal receptacle with product.

In certain variants, the insertion portion may be omitted or be without any engagement members or reliefs for engaging with the peripheral attachment region provided on the internal receptacle, for example by forming the elastically deformable portions on an inner face offset to be higher than the inner side face of the external receptacle.

It is possible, with no risk of cracking, to form the container solely with thermoplastic materials (glass and thermoplastic polymer constituting the annular coupling insert), for example such as PCTA copolyester (possibly bio-sourced, this material also not being subject to stress cracking), a polyester of type PET (recycled or not), PC or PK (polycarbonate and polyacetone, possibly bio-sourced), or polypropylene, typically of type PPR—possibly transparent—or even polyethylene. Such materials are more easily recyclable than thermosetting polymers. PCTA may be preferred for its slightly greater rigidity than polypropylene, which may be an advantage in ensuring that the assembly holds up well (even if the container is turned over with the opening facing downwards).

According to one feature, the insertion portion is a lower portion offset radially inward relative to said neck or receiving member, the second rotation locking means being formed in an upper portion extending upward and/or outward from the insertion portion.

Optionally, the flange is housed in an internal hollow space entirely delimited by the inner face of the insert, preferably such that the flange is positioned lower than the longitudinal opening of the external receptacle. In other options, with or without an upper flange in the internal receptacle, the insert may rest on an inner shoulder or inner step formed in the neck of the external receptacle. The internal receptacle may have a top protruding axially beyond the insert and/or extending at same level as a neck upper surface of the external receptacle.

In some embodiments of the container, recourse may be made to one or more of the following features:

- the neck or receiving member has threads, intended to allow attaching a lid provided with complementary threads, the screw thread thus formed in the neck or receiving member being for example discontinuous and/or extending over less than 360° so that it does not interfere with areas for receiving from above engagement members that are part of the outer portion of the insert.
- the neck or lid-receiving member, which is part of the external receptacle, extends around the annular upper end and has an outer side face provided with at least two recesses to allow a bayonet-type attachment of the insert, by cooperation with the outer portion of the insert.
- a bayonet-type attachment of the insert is achieved by cooperation between reliefs made of glass provided in the recesses, and graspable engagement members formed in said outer portion of the insert, in a peripheral area extending around the longitudinal opening of the external receptacle.
- the insert has no manual actuation devices with the exception of the graspable engagement members formed in the outer portion.
- the engagement members can be actuated by radial inward pressure and are rotatable in both directions when mounted in the recesses (freely rotatable or rotatable with vertical axial clamping, as long as the locking position has not been reached).
- the second rotation locking means allow locking by clamping or snap-fitting which is reversible without modifying the rotationally locked state between the insert and the internal receptacle, as permitted by the first rotation locking means which are preferably of the snap-fitting type, whereby the insert and the internal receptacle form a unit detachable as one piece from the external receptacle.
- a snap-fitting relief is provided (for example a rib of the "grain of rice" type) which projects radially outwards, to form a rotation-preventing barrier at each recess or groove (for example to retain a bayonet lug of the second locking means), which can be overcome by exerting force exceeding a threshold, due to the flexibility/plastic deformation of the longitudinal tabs during rotational movement. The threshold is chosen so as not to accidentally unlock the engagement members present on the insert, the force required to unlock possibly being similar to what is required to unscrew a jar of jam (it being understood that this threshold can be adjusted according to the applications).
- the bayonet-type attachment of the insert is achieved by cooperation between reliefs made of glass provided in the recesses and graspable engagement members formed in said outer portion of the insert, which are preferably longitudinal tabs of the outer portion which define, with the insertion portion, a cavity for clasping said neck or lid-receiving member.
- each of the recesses results from a local reduction in the thickness of the glass constituting the external receptacle and opening onto the top of the external receptacle to allow longitudinal insertion of one of the engagement members (this arrangement allows making use of a ring/neck of the external receptacle to support and attach the insert, and advantageously makes it possible to cause movement of the insert away from the inside volume/cavity of the outer body, while also avoiding interfering contact between the engagement members of the insert and the attachment skirt of the lid).
- the engagement members formed in said outer portion of the insert are longitudinal tabs which, together with the insertion portion, define a cavity to house a portion of said neck or lid-receiving member.
- each of the longitudinal tabs faces a radially movable tongue, provided in the insertion portion, which is defined between a pair of slots among the slots of the insertion portion.
- the insertion portion has a protruding or inward relief to engage with a corresponding inward or protruding relief formed in said attachment region that is part of the internal receptacle.
- the internal receptacle is made of thick glass and/or is thicker than the insert, the thickness of the glass being for example greater than 3 or 4 mm.
- the internal receptacle has a bottom which faces the bottom of the external receptacle, with some axial distance between them; this bottom of the external receptacle prevents access to the internal receptacle from below while having a barrier effect against impurities (which cannot enter the inside volume from below), guaranteeing an aesthetic appearance of the container when the external receptacle is transparent or translucent.
- the container comprises an external lid which comes to engage, by the exterior, with the neck or receiving member (member forming a lid-attaching ring); this arrangement allows a wide choice of lids and a lid skirt can completely cover the top of the ring, so that only the glass body of the external receptacle is visible. It may be that a glass lid is preferred.

a membrane seal for sealing the opening of the internal receptacle and the outer portion of the insert extends entirely within an inside volume of the lid, in the knowledge that the second rotation locking means are provided between an outer side face of the neck or receiving member and a skirt of the lid which carries (on its inner face) the attachment means for cooperating with the neck or receiving member.

the second locking means constitute detachable securing means (detachable securing of the insert on the external receptacle), allowing subsequent disassembly of the insert from the external receptacle subject to/on the condition that the lid is removed.

the external receptacle has an inner face made of glass, surrounding the insertion portion of the insert which is made of plastic, the insertion portion extending annularly at a radial distance from the inner face made of glass.

According to one feature, the insert is made of a single piece of molded plastic. This arrangement makes the assembly simpler to implement. The structure of the insert, with its alternation between relatively flexible/radially inwardly movable portions and rigid portions in the annular area separating an attachment ring provided as the upper end of the external receptacle and the peripheral annular attachment region that is part of the internal receptacle, makes it possible to limit the effects of radial compression on the insertion portion: the elastically deformable portions are at most bent slightly outwards in the locking areas but are not compressed in a clamp.

It is also possible to provide either a total absence of external bearing pressure from the insertion portion against the glass of the external receptacle, or bearing pressures that are regularly distributed and spaced apart, obtained by longitudinal ribs. In the case of an insert which is not rotationally locked by using a screw thread of the internal receptacle, a clamping may be used instead for attachment of the insert around the internal receptacle, in an inserted/engaged position of inner lugs of the elastically deformable portions in a continuous or discontinuous external annular groove of the internal receptacle. In most of these cases, it is understood that reliefs with guidance for a bayonet-type connection may be provided on the attachment region of the internal receptacle, in order to guide and then prevent advancement of the first locking means.

Optionally, the first locking means include locking tongues defined between a pair of slots (among the slots of the insertion portion) and allowing movement by deflection, preferably around a hinge area formed between the pair of slots. For example, each tongue is radially spaced apart from the inner glass face of the external receptacle, by a distance at least equal to 1 mm, and preferably between 1 and 2 mm, in a locking configuration of the first locking means.

For example, two, three, or four tongues (possibly more) may be provided to form the elastically deformable insertion portions. These tongues are distributed regularly along the circumference of the insertion portion, typically alternating with rigid portions of the insertion portion (which extend further in the circumferential direction than the tongues). Threads or other reliefs for guiding the rotation are provided internally on these rigid portions.

According to another aspect, it is proposed to assemble a container by inserting a removable internal glass receptacle into the external glass receptacle, using a coupling insert suitable for directly supporting the annular upper end of the internal receptacle so as to keep the internal receptacle at a distance from the external receptacle while maintaining the internal receptacle in a predetermined axial position relative to the external receptacle, with the particularity that the annular insert has:

an inner engagement face engaged with the peripheral annular attachment region provided on the internal receptacle, this inner engagement face countering an axial upward movement, relative to the insert, of the internal receptacle arranged in the predetermined axial position, the inner engagement face making it possible to obtain a coupling state to immobilize the insert on the internal receptacle with anti-rotation effect;

a radial portion extending above the upper end of the external receptacle, the inner engagement face being formed on a first attachment portion that is part of the insert and is connected to an inner edge of the radial portion while being offset radially inward relative to the upper end of the external receptacle;

and wherein the first attachment portion includes at least one rotation-immobilizing portion which is:

suitable for engaging the peripheral annular attachment region and locking the coupling state, by including at least one rotation-preventing relief (projecting inwards from the inner face of the rotation-immobilizing portion), and defined by slots or indentations in the thickness of the first attachment portion, so that said rotation-immobilizing portion and/or a portion adjacent to the slots or indentations is elastically deformable.

Optionally, the insert is made as one (single) piece. It may have a second attachment portion for connection to a neck of the external receptacle, the second portion being connected to the radial portion (therefore being distinct from the first portion) and forming another inner face of the insert, making it possible to counteract an axial upward movement of the insert relative to the external receptacle. The inner engagement face engaging with the peripheral attachment region of the internal receptacle may have a greater longitudinal extension than the inner engagement face engaging with the neck or similar area at the upper end of the external receptacle.

In some embodiments, the inner engagement face engaging with the internal receptacle may extend to a higher level than the other inner face, for example by extending upwards from the radial portion or by having at least a portion of this inner engagement face which is located higher than the radial portion.

Optionally, the insert is provided with at least one elastically deformable tab, defined/delimited by two slots which are axially open at the top of the insert. This type of tab can make it possible to lock the axial position of the internal receptacle.

Independently of or in addition to the above, the internal glass receptacle may protrude upwards relative to the external receptacle, in its predetermined axial position, and have a flange which extends higher than the upper end of the external receptacle, with some space longitudinally/heightwise between it and this external receptacle. The internal receptacle has an outer side face which has two areas with relief(s): one located under the flange for the attachment to an inner face of the annular insert, and the other located on the edge of the flange for attaching a lid, which may optionally be:

a temporary refill lid having a first height, and a lid of the container having a second height greater than the first height, so as to extend annularly around all or part of a neck or similar open upper end of the external receptacle.

This arrangement makes it possible, at the end of a part made of glass that is well suited for packaging cosmetic products, to join several areas together in a robust attachment. It becomes easier to close a cartridge including the internal receptacle by a rigid lid, protecting the membrane having a contact layer which may be flexible and well suited for sealing closed (by heat sealing for example) the opening of the internal receptacle. The membrane may be a film, plastic, or metal, possibly multi-material, typically of a type that is known per se for cosmetic applications.

The height corresponding to the edge of the flange is for example between 3 and 8 mm, preferably between 4.5 and 7 mm. Furthermore, the annular insert rests on the upper end of the external receptacle by a radial portion which entirely extends lower than the two areas with relief(s). The radial portion is typically annular in shape in order to completely cover the upper face of the neck of the external receptacle.

According to one feature, the inner face of the annular insert has inwardly projecting reliefs for rotational guidance, allowing the screwing of reliefs of the internal receptacle or guidance of one or more key(s) of the internal receptacle (at its peripheral attachment region) towards a position of rotational immobilization.

Typically, the one-piece insert has another inner face, offset outwards relative to a neck of the external receptacle and connected to the radial portion, in order to engage with one or more engaging edges formed in the neck (neck formed at the upper end of the external glass receptacle).

According to another aspect, a method of assembly is proposed for obtaining the container according to the invention, making it possible to mount (fixedly) an internal glass receptacle in an external glass receptacle, the method possibly comprising, preferably successively:

coupling of an annular insert around the internal receptacle, preferably by screwing, until a locking configuration is reached in which a lower portion of the insert is rotationally locked at or under an annular upper end of the internal receptacle, preferably under an upper flange of the internal receptacle, by engagement of first locking means, each formed in an inner engagement face of the lower portion, against reliefs of an annular peripheral attachment region of the internal receptacle, the first locking means being provided in at least one elastically deformable portion separated from the rest of the lower portion by slots;

the hermetic sealing of an opening of the internal receptacle, which is preferably a single opening having served for introducing product into a cavity of the internal receptacle;

mounting/assembling by insertion, parallel to a longitudinal axis of the internal receptacle, of the internal receptacle into a volume of the external receptacle, through a longitudinal opening of the external receptacle defined by a neck or lid-receiving member, until the lower portion of the insert coupled to the internal receptacle becomes an insertion portion inserted through the neck or receiving member (portion inserted between face-to-face glass walls which are respectively part of the internal receptacle and the external receptacle); and integrally securing the insert and the neck or receiving member by engaging, on engagement edges formed on this neck or receiving member, second rotation locking means formed in one or more regions of the insert which are separate from the at least one elastically deformable portion, in order to block relative rotation between the external receptacle and the insert.

With these arrangements, the assembly is robust and replacement operations can be easy, in particular when graspable/manually operable members are provided for changing the position of the second locking means, with knowledge that the second locking means are typically in an outer portion (accessible from the outside) of the coupling insert.

According to one option, the integral securing of the insert to the neck or receiving member is carried out by pivoting the insert relative to a longitudinal axis of the external content, and constitutes an attachment that is detachable, enabled in response to a reverse pivoting movement manually actuated on actuating members or surfaces provided on the outside of the external receptacle and included in the second locking means, the second locking means being formed in an outer portion of the insert which is distinct from and preferably complementary to the insertion portion, and wherein the pivoting of the insert is carried out while maintaining a predetermined distance between the insertion portion and the neck or receiving member.

Typically, an external glass receptacle is provided which is molded as one piece by a simple press. Independently or in addition, the internal receptacle may be a piece of glass. It may be made of thick glass with a bottom thickness greater than or equal to 3 mm, for example at least as thick or thicker, in its part underlying the flange, than the minimum thickness of the external receptacle.

In some embodiments, the lower portion of the insert is suitable for rotationally guiding the internal receptacle by engaging its peripheral attachment region and couples with the internal receptacle so as to prevent relative rotation of the internal receptacle with respect to the insert. The insert has at least one tab defined between two slots that is elastically deformable and able to be offset radially outwards when unlocking the coupling state between the insert and one and/or the other among the internal receptacle and the external receptacle, this tab preferably being provided in the outer portion of the insert which is complementary to the lower/insertion portion.

The method of assembly may be carried out so as to allow selective removal of the internal receptacle, by rotating and/or pulling on a flange of the internal receptacle provided externally to the external receptacle in the final assembled position of the container, with knowledge that the insert has elastically deformable tabs provided in an outer portion of the insert, enabling:

axial disengagement of the internal receptacle in response to an action of pulling the flange upwards relative to the insert coupled to the external receptacle at the neck of the external receptacle, each of these tabs preferably being defined/delimited by slots or indentations within the thickness of the insert.

For this, the elastically deformable tabs typically engage under an engagement edge, for example formed by the underside of an annular bead or at least one similar relief of the peripheral attachment region provided on the internal receptacle, under the flange. This engagement preferably takes place when the internal receptacle is in a predetermined angular position relative to the insert, such that the internal receptacle is already rotationally locked when the elastically deformable tabs are deformed to engage the attachment region. In some options, the flange has an edge provided with reliefs forming engagement means for one or more complementary attachment members provided in a pulling tool which allows exerting pulling action on the flange, the pulling tool being for example in the form of a lid sealing off the internal receptacle and able to be rotationally coupled on the flange by use of the engagement means.

According to another aspect, a product reservoir device is proposed, composed of the coupling insert and the internal glass receptacle of said container according to the invention, and forming a cartridge of this container suitable for being interposed between the external receptacle of the container and a lid which comes to be fixed externally on an outer side face of an annular upper portion, in particular a neck, of the external receptacle, the insert of the reservoir device being made as one piece and comprising an outer portion, separate from and preferably complementary to the annular insertion portion, which typically can constitute a pivotably/rotatably operable portion.

Preferably, the coupling insert includes:

at least two longitudinal tabs spaced apart radially outwards relative to the insertion portion and each making it possible to define, with the insertion portion, an immobilization cavity suitable for receiving a segment of the upper annular portion of the external receptacle, and an annular radial portion suitable for covering a top of the external receptacle and which connects the insertion portion to each of the longitudinal tabs.

In some embodiments, each of the longitudinal tabs is provided with a lug projecting inwards into the corresponding immobilization cavity in order to allow detachable securing of the reservoir device forming a cartridge, to the external glass receptacle, which is a receptacle of the type provided with a bayonet connection system including recesses on an outer side face of the upper portion of the external receptacle.

BRIEF DESCRIPTION OF THE DRAWINGS

Other features, details, and advantages of the invention will become apparent upon reading the detailed description below, and upon analyzing the appended drawings, in which.

DESCRIPTION OF THE PREFERRED EMBODIMENTS

Figure 1:
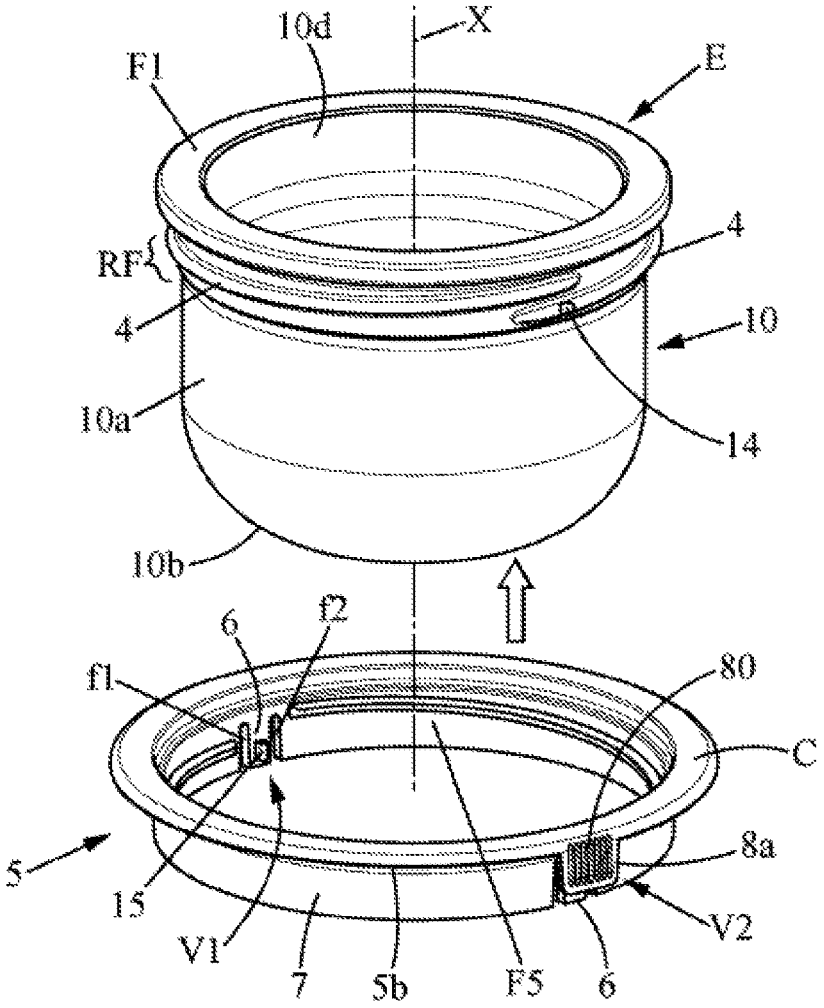
FIG. 1 is an exploded perspective view showing a ring or insert according to a first embodiment of the invention before its mounting on an annular peripheral attachment region of an internal receptacle, under a flange of this receptacle.

In the various figures, identical references indicate identical or similar elements.

In the figures, the respective axes X and X' of the internal receptacle 10 and of the external receptacle 20 are positioned vertically. The receptacles 10, 20 are distinct from one another and can therefore be designed separately. In the figures (in particular in vertical section views), the upward/downward direction is defined to follow the direction of the longitudinal axes, so that the width direction of the container is a radial direction and the height direction of the container or of one of its components is a longitudinal direction.

Referring to FIG. 1, FIGS. 7 and 8, and FIGS. 15 and 16, it is provided that a reservoir for product is formed as one piece of glass, which is an internal receptacle 10 of inert rigid mineral material. The glass used to form the external receptacle 20, visible in FIGS. 7 and 8 in particular, is preferably obtained from silica and is typically transparent or translucent. The glass of the internal receptacle 10 and of the external receptacle 20 may be identical or different; the internal receptacle 10 may be opaque in certain options. The glass of the internal receptacle 10 is well-suited to form a chemically inert material (without interior coating or lacquering), allowing contact that is compatible with long storage of a product 2 poured/deposited in the internal receptacle 10.

Internal Receptacle

The internal receptacle 10, also called a cup, may have a tubular side wall 10*a* which extends around the longitudinal axis X between a bottom wall 10*b*, for example with a bottom that is flat or rounded (to form a downward dome), and an axial annular upper face F1, surrounding a single opening 10*d* of the internal receptacle 10. A flange 10*c* may define the axial annular upper face F1. The receiving volume (corresponding to a single cavity here) of the internal receptacle 10*a* may be suitable for storing the cosmetic, pharmaceutical, or other product which is typically fluid, semi-fluid, or pasty, inside the external receptacle 20.

Although the drawings show a single compartment for receiving the product 2, it may be arranged to form a longitudinal separating wall connecting two separate regions of the inner face of the side wall 10, in order to form at least two separate compartments within the internal receptacle 10.

Figure 12:
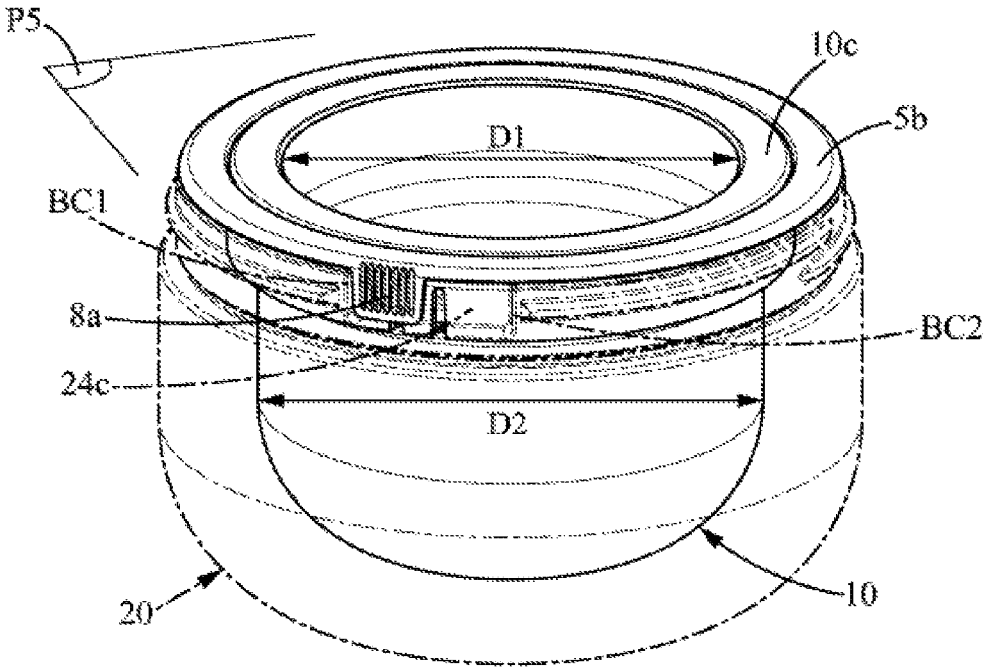
FIG. 12 is a view similar to that of FIG. 7, in a locked configuration of the insert which corresponds to a bayonet-type attachment.

Referring to FIG. 12, the width or outer diameter D2 of the internal receptacle 10 at mid-height may be at least equal to 90% or 100% of the inner diameter D1 of the opening 10*d* of this receptacle 10, in order to optimize the capacity of the internal receptacle and thus minimize the spatial area between the receptacles, which corresponds to an annular volume not intended to receive any content in most of the applications envisaged. In the example shown, the relation D2>D1 is satisfied. In addition, the height H of the internal receptacle 10 may represent more than 85 or 90% of the total height of the external receptacle 20.

On the outer face of the side wall 10*a*, a peripheral attachment region RF is formed, which extends annularly here under the flange 10*c*, in a position adjacent to the flange 10*c*. This region RF forms a surface with one or more coupling reliefs 4, 14 for securing and rotationally locking a lower portion of a mounting/coupling insert 5. It is well understood that the region RF is composed of glass and is therefore rigid, having no deformable parts.

Figure 23:
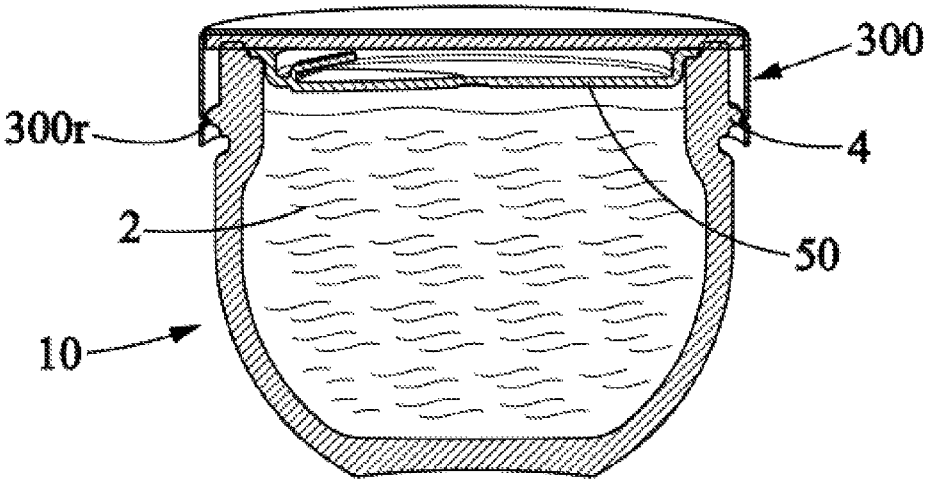
FIG. 23 is a longitudinal/vertical section view of an exemplary internal receptacle, tightly closed by a removable lid, with the peripheral attachment region here retaining the lid instead of the insert for nomad application.

Referring to FIG. 23, the receptacle 10 is suitable for nomad use, with the external receptacle 20 removed and typically without the insert 5 as well, using a removable closure lid 300 directly coupled with the coupling reliefs 4 available on the peripheral attachment region RF. The removable closure lid 300 may initially cover a membrane seal 50 that is in a tightening configuration, with axial interposition between the upper end/face F1 of the receptacle 10 and a closing part (possibly provided with a flexible liner, an inner membrane or inner skirt) of the removable closure lid 300. An annular outer skirt of the removable closure lid 300 may include an inner thread or similar internal relief 300*r* for rotational attachment (screwing for instance) onto the attachment region RF. Optionally, as illustrated in FIGS. 20 and 23 in particular, the receptacle 10 may be deprived from any flange or similar part protruding radially outward from the internal receptacle upper end.

Figure 10:
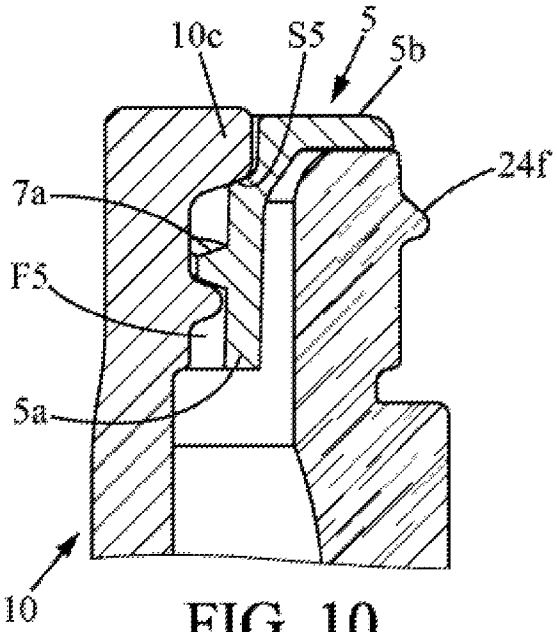
FIG. 10 is another vertical section view, illustrating in detail a profile of the insert forming an interface between the internal and external receptacles.
Figure 9:
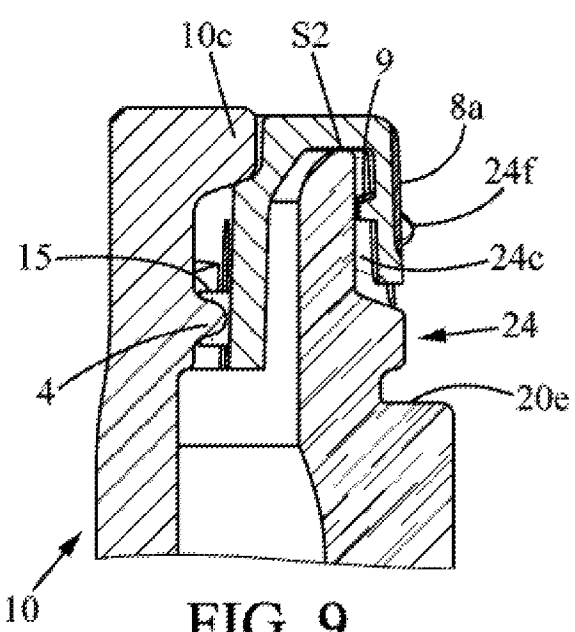
FIG. 9 is a vertical section view, illustrating in detail a profile of the insert forming an interface between the receptacles, respectively internal and external.

The optional flange 10*c* shown in FIGS. 9-10 is an upper flange, which may directly surround the opening 10*d*. In this example the receptacle 10 consists of the body (10*a*, 10*b*) forming a reservoir portion, and the flange 10*c* or any similar upper end suitable, possibly adapted for receiving a membrane seal 50. The attachment region RF is formed at the upper end of the body (10*a*, 10*b*), typically extending to a height of no more than 10 or 15 mm and/or not representing more than 20 or 30% of the total height H of the internal receptacle 10.

Figure 7:
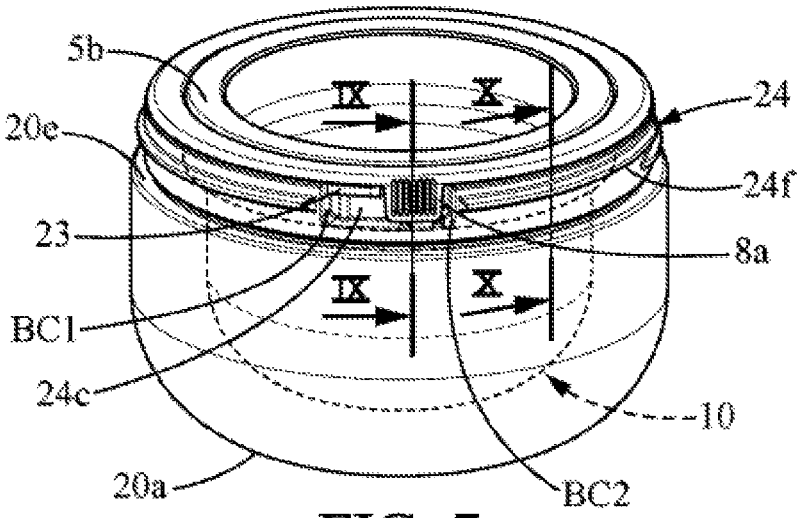
FIG. 7 is a perspective view showing the container in an end-of-assembly phase, in a configuration where all that remains is to rotate the insert to lock it on the external receptacle, using a bayonet connection system distributed between an outer portion of the insert and the neck/member of the external receptacle forming the lid receiver.
Figure 11:
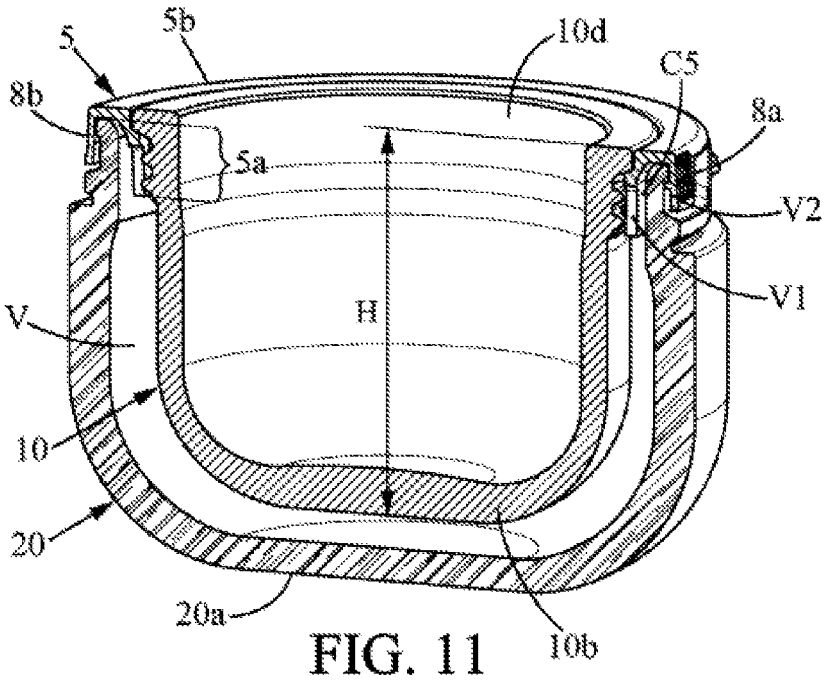
FIG. 11 illustrates, in vertical section, a container obtained by assembling the internal receptacle shown in FIG. 1 with the external receptacle shown in FIG. 8, by using an insert according to a first embodiment.

The insert 5 is provided to cover this attachment region RF, here in an annular manner, by means of an insertion portion 5*a* whose extension in height (i.e. vertical extension in the drawings) may correspond substantially to that of the attachment region RF. This allows the insert 5 to be supported by the internal receptacle 10 while leaving the body (10*a*, 10*b*) clearly visible, with more than three quarters of the height of this body being visible as shown in FIGS. 7 and 11-12 when the external receptacle 20 is transparent. The amount of plastic material of the insertion portion 5*a*, which is the portion of the insert extending between the glass walls of the two receptacles 10 and 20, can thus be reduced.

Figure 20:
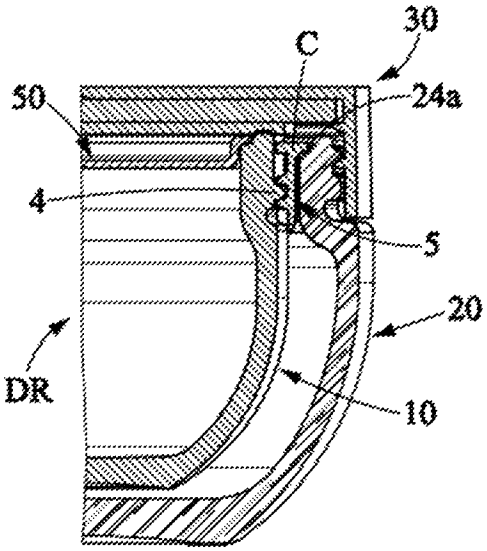
FIG. 20 illustrates, along in vertical section, a closed container with the internal receptacle suspended using an exemplary insert resting on an inner shoulder provided in the neck of the external receptacle.

The insert 5 may optionally entirely consist in such insert portion 5*a*, as illustrated for instance in FIG. 20.

Here the terms "adjacent" or in a position "adjacent" to the flange are to be understood as designating a position directly contiguous to or spaced apart by less than 10 mm, preferably less than 6 mm, from the lower face of this flange 10*c*. In this manner, the region RF is contiguous or very close to the flange 10*c*, which allows the lower portion forming an insertion portion 5*a* of the insert 5 to present a reduced longitudinal extension, for example less than 15 or 20 mm, while enabling a robust assembly of the internal receptacle 10 in the external receptacle 20.

In other variant embodiments of the insert 5', 105, the arrangements for covering the region RF may be applied with a different structure of the insertion portion 5*a* or in the absence of such an insertion portion. In some options, the internal receptacle 10 may be secured to the insert 5', 105 by using the RF region, typically during a last step in the assembly of the container 1. For example, the peripheral region RF serves to create the attachment between the insert and the internal receptacle only when the internal receptacle 10 has already been sealed with a membrane seal and bears a lid 30 covering the flange 10*c*, while the insert 5', 105 has already been mounted on the external receptacle 20.

Although the examples illustrated show a flange 10*c* delimiting the opening 10*d*, it is understood that the internal receptacle 10 may also simply have a thickening at this annular upper end E, possibly with a profile of progressively increasing thickness, so as to dispense with the flange and thus minimize the amount of material for forming the internal receptacle 10. At least one groove formed in the upper end E or other types of anchoring reliefs may make it possible to obtain an axial retention effect of the internal receptacle 10 relative to the insert 5, 105. An anchoring of this type is generally more effective, by coupling the insert 5, 105 and the internal receptacle 10 on a continuous annular contact area or a peripheral region in which the discontinuities are of reduced size compared to the engagement sub-areas.

External Receptacle

Figure 8:
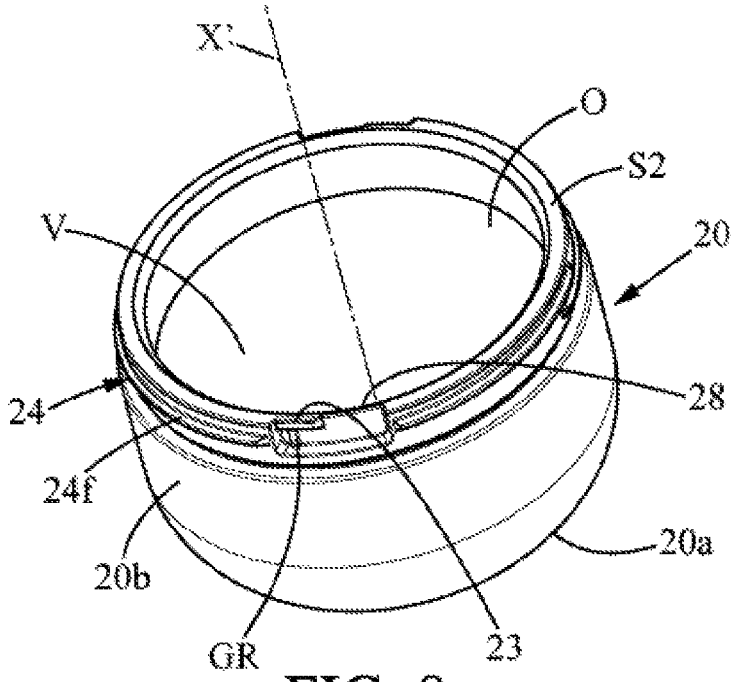
FIG. 8 is a perspective view showing the external receptacle with its wide axial opening, in an option with securing reliefs, here projecting radially outwards to allow a bayonet-type attachment of the insert without interfering with the screw thread provided in the neck or lid-receiving member provided as the annular upper end of the external receptacle.

In the examples illustrated in FIGS. 7 and 8, the external receptacle 20 has a volume accessible via a longitudinal opening O defined by a neck or receiving member 24. This type of neck or receiving member 24 makes it possible to attach a lid 30, visible in FIG. 14. The external receptacle 20 has a bottom 20*a* and a side wall 20*b* which extends longitudinally around an axis X', to the annular neck 24.

Referring to FIGS. 7 to 12, an outer shoulder 20*e* of the receptacle 20 can separate/make the transition between the side wall 20*b* and the annular neck 24. The upper outer face S2 of the receptacle 20 is part of the neck 24, and an attachment area for a lid is provided which is offset longitudinally downwards relative to the outer face S2. This attachment area is located in a longitudinal extension of the side wall 20*b* but typically set inwards relative to an outer face of the side wall 20*b*, due to the shoulder 20*e*. Here, the screw thread 24*f* provided in this area (for attaching a lid 30 of the container 1) is therefore positioned so that it does not extend further outward than the side wall 20*b*.

In addition, as can clearly be seen in FIGS. 7 to 9 and 11-12, the annular neck 24 has recesses 24*c*, here formed by reductions in the thickness of the neck 24 (on the outer side), for receiving engagement members provided in an outer portion 5*b* of the insert 5. Thus, as shown in FIG. 9, in the regions of the neck comprising these recesses 24*c*, the glass outer surface of the external receptacle has a longitudinal profile with successively, from bottom to top:

- a first inward indent resulting from the shoulder 20*e*,
- a possible outward bulge, preferably annular, and
- a second inward indent resulting from a lower edge of the recess 24*c* for receiving an engagement member.

As will be described below, the recesses 24*c* may be at least two in number in order to form guides for a bayonet attachment. The inset made possible by the recesses 24*c* is also advantageous for enabling the annular neck 24 to be covered externally by two separate attachment elements: one to come into contact against the outer side face of the neck in the recess 24*c*, the other (lid) to come into contact against the outer side face of the neck outside of the recesses 24*c* while covering the engagement members of the insert 5, for example tabs 8*a*, 8*b* received in these recesses 24*c*.

Each recess 24*c* may be delimited, along a longitudinal direction parallel to axis X', between its lower edge and the upper face S2 of the external receptacle 20, so as to be open axially at the top, as is clearly visible in FIGS. 7 and 8. Two longitudinal edges or sides B1, BC2, here parallel to axis X', further delimit this recess 24*c* laterally. Approximately half of the upper opening 28 of the recess 24*c* is blocked by a protruding rib 23. This rib 23 extends, in a circumferential direction, between a longitudinal edge BC1 and a median/middle area which is at a distance from the longitudinal edges BC1 and BC2.

Figure 22:
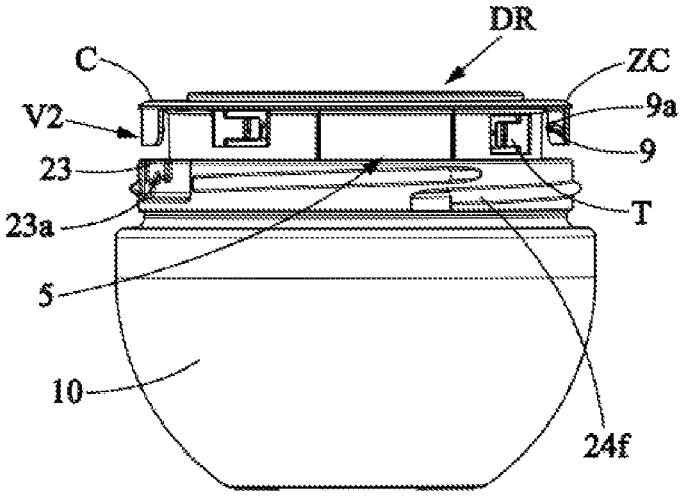
FIG. 22 illustrates an embodiment using a bayonet-type attachment compatible with a screwing around the neck, the reservoir device being here partly inserted inside the external receptacle, so that the insert inner portion and bayonet connection means included in the insert outer portion are both apparent above the external receptacle longitudinal opening.

Referring to FIG. 22, ribs 23 or similar external engaging edges of the neck 24 may include a notch or indentation 23*a*, allowing a locking element 9*a* (here formed as an element protruding upwardly from the axial retainer/projecting member 9) to be engaged in the indentation 23*a*. Such locking element 9*a* improves guiding effect, minimizing constraints on the insert 5 when handling the outer portion 5*b*.

In a variant not using a bayonet-type connection, the recesses 24*c* may be replaced by an annular groove preferably located higher than the screw thread 24*f* or other similar device for attaching a lid. In other options, it may be arranged to use a lid connected by a hinge or in an articulated manner, for example directly connected to the external lid 30 or possibly to the insert 5.

In the example illustrated in FIGS. 15 to 19, a circumferential (annular) groove G20 is provided in the neck 24 of the external receptacle 20. This type of groove G20 is compatible with a neck 24 not extending very high. The circumferential groove G20 may be directly defined between the outer shoulder 20*e* of the external receptacle 20 (corresponding to the base, lower side, of the neck 24) and an upper rim 24*r* of the neck 24. In some embodiments, this facilitates complete coverage of the neck 24 by an outer portion 5*b* of the insert 105, which can give a more refined appearance to the container 1 when the lid 30 is removed/absent.

Regardless of the manner in which the lid 30 is connected to the external receptacle 20, fluidtight sealing may optionally be provided, directly by screwing and/or contact on a flange of the neck, and/or by an inner skirt or lip of the lid 30 to allow at least annular contact around the opening 10*d*.

Figure 15:
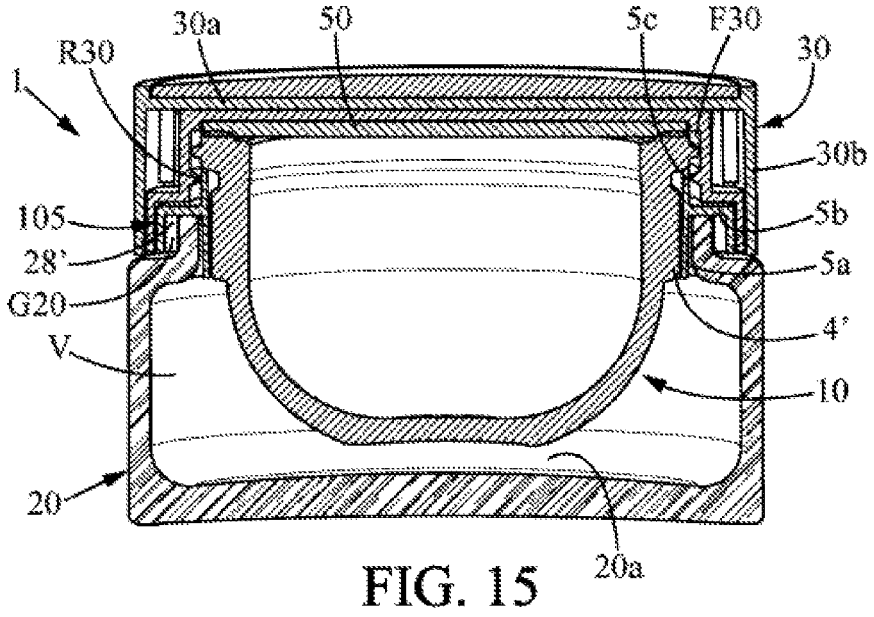
FIG. 15 illustrates, in vertical section, a container obtained by assembling the internal receptacle shown in FIG. 16 with the external receptacle shown at the bottom of FIG. 19, by using an insert according to a third embodiment.
Figure 18A:
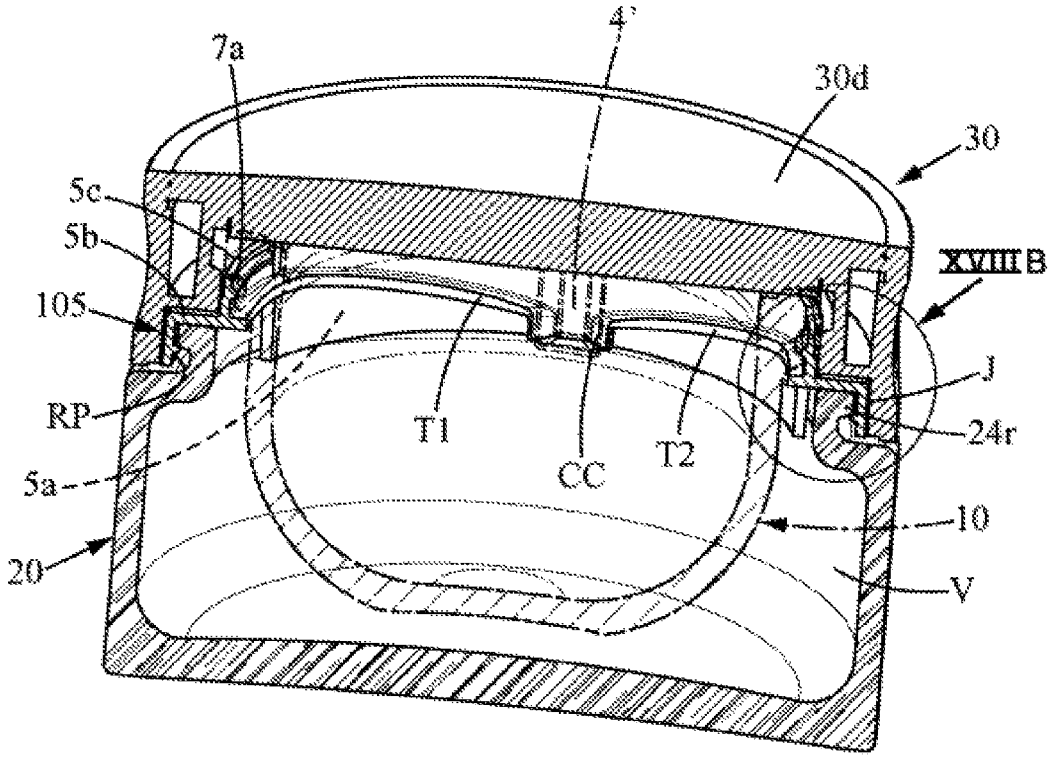
FIG. 18A shows, with a perspective effect, a vertical section view similar to that of FIG. 15, passing through the longitudinal axis of the internal receptacle but at an angular offset of 90 degrees.
Figure 19:
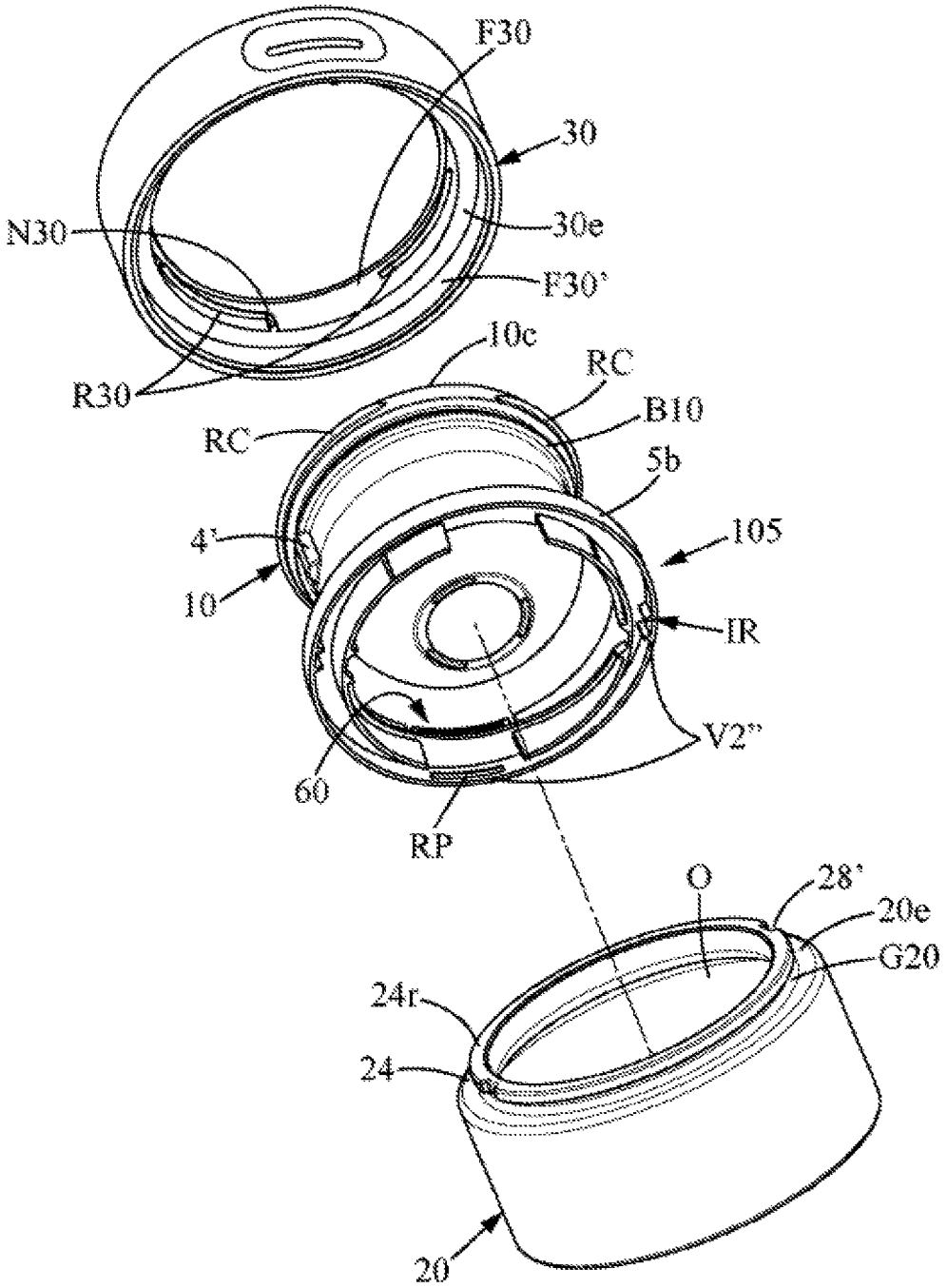
FIG. 19 is an exploded view of the container of FIG. 15.

The lid 30 may be separate from a membrane seal 50 initially closing off the opening 10*d*. Alternatively, the lid 30 may include a layer having a sealing function by covering the opening 10*d*. In FIGS. 15, 18A, and 19, the lid 30 thus has a bottom portion 30*a* supporting a membrane seal 50 forming such a layer. This arrangement makes it possible to avoid having to throw anything away when first opened, the membrane seal 50 then being reusable while remaining integral with the lid 30 which comes to attach around the insert 105.

Preferably, the lid 30 may be of the screwing type and has a low sealing position in which an inner face F30 of the lid engages, via reliefs N30 forming an abutment, against protruding travel-arresting stops 35 formed externally on the insert 5. A progressive tightening effect may optionally be provided by a beveled shape of the stops 35 (stoppers having a progressively increasing cross-section along the direction in which the lid 30 is screwed).

In some embodiments, the external receptacle 20 may have reliefs, threads for screwing, a clamping, or any coupling requiring relative rotation, these reliefs being suitable for locking a low position of the lid 30. Alternatively, the external receptacle 20 has a streamlined upper end, typically with a single groove G20 placed under a rim 24*r*, the attachment of the lid 30 and the locking being implemented at the outer side face of the insert. The non-limiting case of FIGS. 18A and 18B corresponds to an example of these alternatives, with an insert 105 able to cooperate with an inner annular region of the lid 30.

Although the drawings show an inside volume V of the external receptacle 20 where the depth corresponds substantially to the total height of the internal receptacle 10, other accommodation arrangements may be considered for fully or partially receiving the internal receptacle 10 within the inside volume V. More generally, the height H of the internal receptacle 10 may vary, even if it may be preferred—for reasons of bulk and of optimized filling with product 2 relative to the overall size of the container 1—to limit the difference in height between the receptacles 10 and 20 to less than 20 or 25 mm. It is also possible to place the top of the internal receptacle 10 more than 5 or 10 mm lower than the level of the longitudinal opening O of the external receptacle 20.

Features of Coupling Insert as Illustrated

Figure 4:
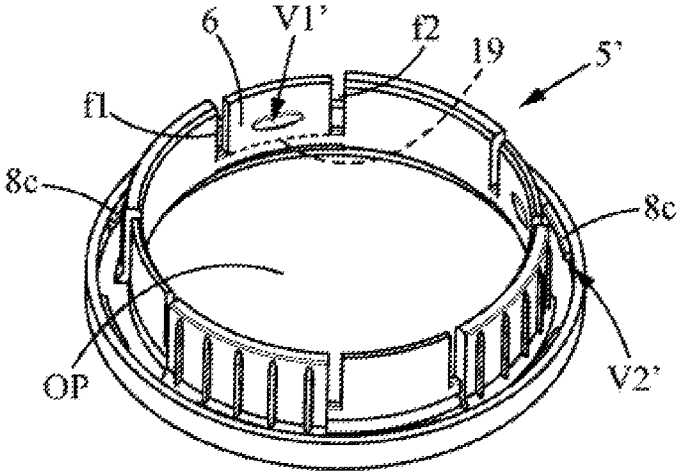
FIG. 4 is a view similar to that of FIG. 3, showing the insert turned upside down to illustrate members capable of engaging with one or more engagement edges provided on the neck or lid-receiving member of the internal receptacle.
Figure 5:
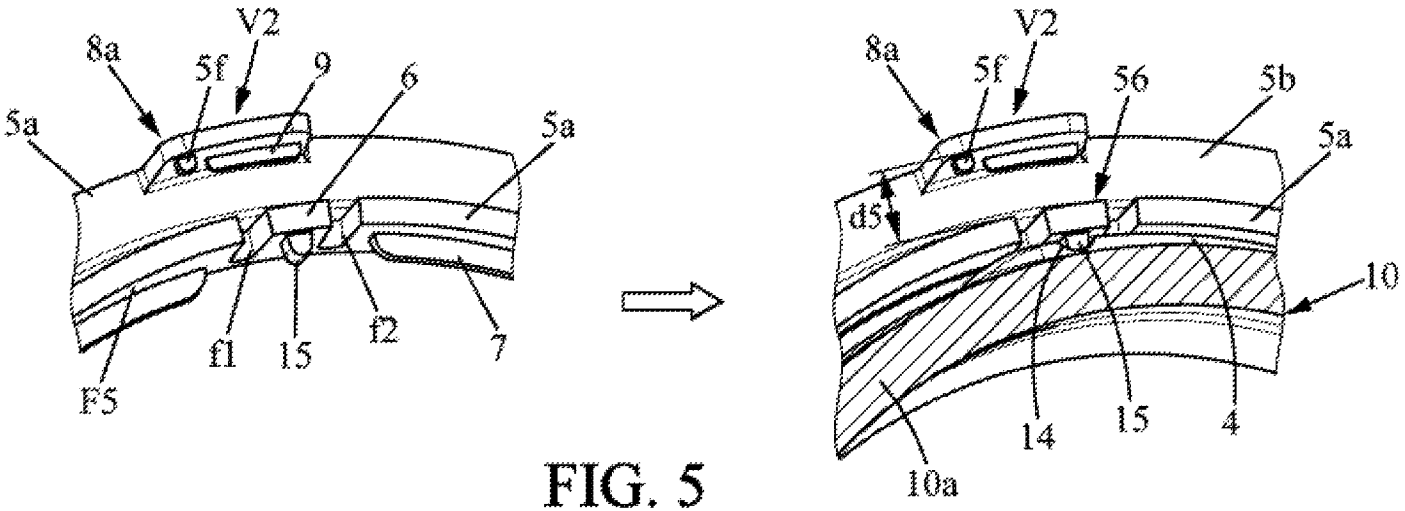
FIG. 5 shows details of part of an insert according to the first embodiment, respectively before and after coupling to the internal receptacle.
Figure 6:
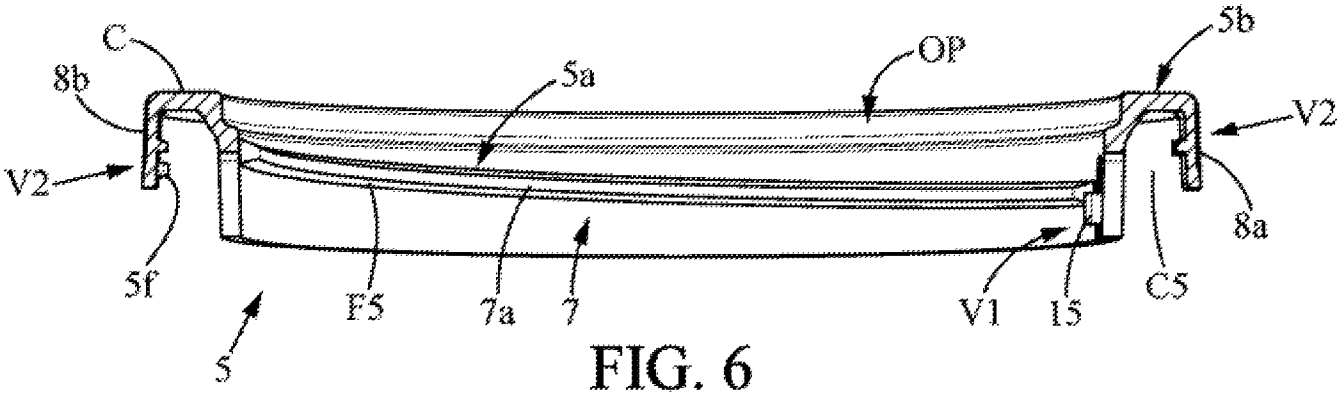
FIG. 6 is a longitudinal/vertical section view, illustrating an adapter insert according to the first embodiment.

Referring now to FIGS. 1 to 6, 9-10, and 17A-17C, the insert 5, 5', or 105 has an annular shape around a central axis which typically can be coincident with the respective longitudinal axes X, X' of the receptacles 10, 20, in the assembled state of the container. In a longitudinal section view as can be seen in FIG. 6, the insert 5, 5' has an inverted "L" or "J" profile. The insert 5, 5' thus has an annular radial portion C which can form a transition portion between the insertion portion 5*a*, intended to be interposed between two glass walls of the receptacles 10 and 20 and serving to couple the insert-internal receptacle, and the retaining means with rotational locking which enable coupling the insert—external receptacle.

Figure 21A:
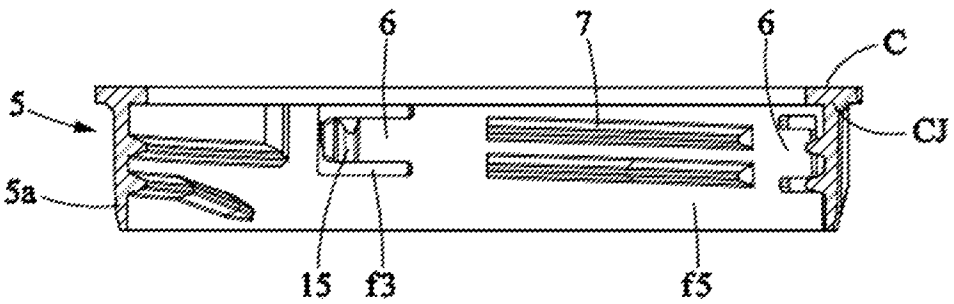
FIG. 21A is a longitudinal/vertical section view, illustrating an adapter insert suitable to be surrounded by the external receptacle neck as in FIG. 20.
Figure 21B:
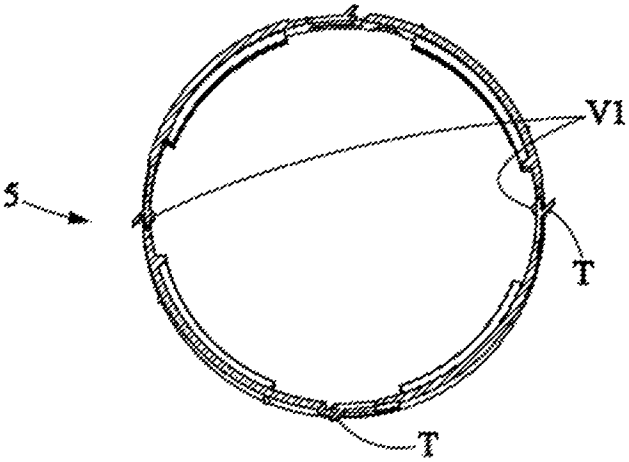
FIG. 21B is a transverse section view, illustrating the single piece adapter insert of FIG. 21A with external lugs preventing rotation of the reservoir device inside the external receptacle.

Also, a "T" profile may be provided for the insert 5, as illustrated in FIGS. 20, 21A-21B for instance. The peripheral attachment region RF may have at least one coupling relief 4 engaged with the insert 5 below an inner protruding edge or protruding part (protruding radially inward from an annular junction CJ) of the annular radial portion C. Here, the annular radial portion C may possibly be contained in the inside volume V. Besides, the annular radial portion C may be provided with a chamfered portion ZC, for instance in an outer annular part adjacent to the exterior side face of the neck 24.

Figure 18B:
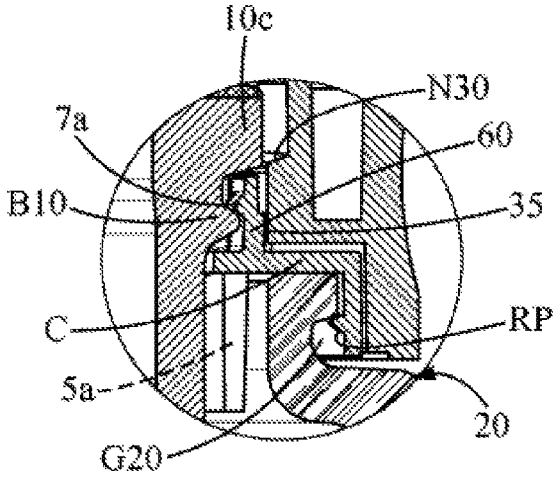
FIG. 18B shows details of the section view of FIG. 18A.

In FIGS. 15 and 18A, 18B, the insert 105 has an h-shaped profile. More generally, different geometries can be used, with the annular radial portion C which makes the transition between the insertion portion 5*a*, or portion proximal to the X axis serving to couple the insert—internal receptacle, and the retaining means which enable coupling the insert—external receptacle.

The presence of an upwardly protruding projection 5*c* allows the insert 105 to retain the lid 30. Optionally, it may also allow the implementation of guidance for reliefs 4' provided externally on the internal receptacle 10. In the case of the internal receptacle 10 of FIG. 16, this may constitute all or part of a refill that can easily be mounted on the reusable assembly consisting of the insert 105 and the external receptacle 20 (the lid 30 also being reused and attached after the internal receptacle 10 is in place). The protruding projection 5*c* facilitates insertion of such a refill by a user, by laterally delimiting the guide region where keys or similar reliefs 4' of the internal receptacle 10 are engaged by resting axially on the guide ramps T1, T2 which can be seen in FIGS. 17B to 18A. In other words, the projection 5*c* facilitates guidance during positioning of the internal receptacle 10 to a predetermined angular position, by the rotational indexing means provided on the insert 105 (typically on the inner face F5). It is possible for the protruding projection 5*c* to allow eliminating the insertion portion 5*a* when the attachment region RF can be engaged at a height level that is at least equal to the level of the radial portion C, in the coupled state of the insert—internal receptacle.

Axial retention of the insert 5, 5', 105 so that it remains integral with the external receptacle 20, is for example enabled:

- by the radial annular portion C which can bear against the upper face S2 and/or by any other portion of the insert 5, 5', 105 bearing axially on the external receptacle 20 (retention preventing the insert 5, 5', 105 from moving downwards);
- and by retaining elements/protruding members 9 or 8*c*, RP, which come to be housed in a circumferential groove or under ribs 23 or similar external engaging edges of the neck 24 (retention preventing the insert 5, 5', 105 from moving upward).

As the longitudinal dimension of the insert 5, 5', 105 is typically restricted (as already mentioned above), the insertion portion 5*a* may extend longitudinally over 15 mm or less, while forming an inner engagement face F5 provided with various reliefs and relatively rigid parts 7 offering little or no deformation during assembly operations to enable coupling of the insert-internal receptacle.

In FIGS. 9 and 10 or in FIG. 18B, one can see that the insertion portion 5*a* has an average thickness (in areas without protruding reliefs) which is not greater than the average thickness of the radial annular portion C included in the outer portion 5*b* of the insert 5. It is also possible to space the insertion portion 5*a* apart from the external receptacle 20, so that the insertion portion is only in selective contact with the internal receptacle 10.

The insert 5, 5' makes it possible, via first locking means V1, V1' provided on the insertion portion 5*a* on the side of the inner engagement face F5 around the internal receptacle 10, to integrally secure the insert 5, 5' to the internal receptacle 10. The insert 5, 5' also enables integrally securing onto the neck 24 of the external receptacle 20, by second locking means V2, V2' provided in the outer portion 5*b*, for example in an outer skirt or on longitudinal tabs 8*a*, 8*b* connected to an outer edge of a radial annular portion C of the insert 5.

With reference to FIGS. 1 to 6 and 9 to 11, provision may more generally be made that the second locking means V2, V2' for locking in rotation are formed in a portion of the insert 5, 5' which is an outer portion 5*b* distinct from the insertion portion 5*a* and suitable for covering or wrapping the annular upper face S2 of the external receptacle 20.

Engagement members are for example provided in the outer portion 5*b* of the insert 5 or 5', in order to prevent this insert 5, 5' from being dislodged from the external receptacle 20 or depressed/pushed further towards the bottom 20*a* within the inside volume V of the external receptacle 20, despite the typical absence of contact of the insertion portion 5*a* against the external receptacle 20. The engagement members may include or consist of tongues 8*a*, 8*b*, as in the example of insert 5 shown in FIGS. 1 and 5-6. FIG. 5 illustrates a tongue 8*a* which has, on its inner face, a certain number of internal reliefs 5*f* and 9 to allow guided rotation in the corresponding recess 24*c* of the external receptacle 20, by cooperation under a projecting guide rib 23 clearly visible in FIGS. 7 and 8. The projecting member 9 forms a retainer in axial abutment which can be combined with the outer annular radial portion C of the insert 5 to form opposite abutments which stop axial movement, in a locking configuration between the insert 5 and the external receptacle 20.

The guide rib 23 then acts as an axial stopper when it is rotated about an axis (here vertical in the drawings) in order to occupy the intermediate space between the projecting member 9 and a lower edge of the recess 24*c*, which prevents the insert 5 from moving upwards. In this locking configuration, the insertion portion 5*a* can no longer exit the external receptacle 20. The projecting member 9 thus acts to retain by the bottom, opposing any upward movement of the insert 5 relative to the neck 24. The insertion portion 5*a* cannot sink further in either, due to the axial contact of the outer portion 5*b* of the insert established, in this locking configuration, against the upper face S2 defined by the neck or ring/similar receiving member 44 of the external receptacle 20. Here, two tongues 8*a*, 8*b* each provided with a projecting retaining member may suffice for engaging in the receiving recesses 24*c* and enabling a bayonet-type connection.

Figure 3:
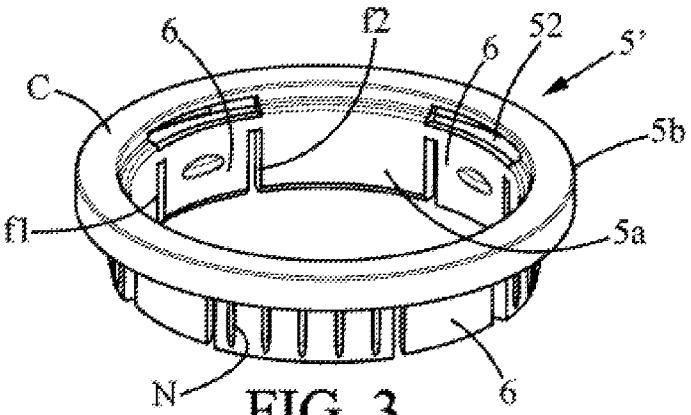
FIG. 3 is a perspective view showing an annular adapter insert for inserting an internal receptacle into an external receptacle, corresponding to a second embodiment.

Alternatively, more engagement members may be provided and locking may be achieved without relative rotation between the insert 5' and the external receptacle 20. FIGS. 3 and 4 thus show simple internal ribs or similar engagement members 8*c* distributed on an outer skirt formed in the outer portion 5*b* of the insert 5'. In this case, the recesses 24*c* may be replaced by a groove located in a region longitudinally interposed between the top of the neck 24 and the screw thread 24*f* provided for attachment of a lid 30.

In the example of FIG. 1, the insert 5 is a plastic part whose thickness is chosen to prevent radial deflection in at least two arcuate portions 7 of the insertion portion 5*a* which have a circumferential extension corresponding to a sector angle of at least 60 or 90°.

In the example of FIGS. 3 and 4, the insert 5' is a plastic part whose thickness may vary and/or which may have reinforcing ribs N to prevent radial deflection in least two arcuate portions 7 of the insertion portion 5*a* which have a circumferential extension corresponding to a sector angle of at least 45 or 50°.

In all these cases, elastically deformable portions 6 are provided which are defined between two slots f1, f2 and which carry internal lugs that will be described below. The material is chosen to be less flexible than an elastomer, which makes it possible to form arcuate portions that are relatively rigid and thus not very deformable by radial deflection. The case of FIG. 13B illustrates a case in which the two slots defining the portion 6 are obtained by a notch f3 composed of several slots due to its nonlinear geometry, for example by having a C or U shape. The portions 6' of the embodiment of FIGS. 15 to 19 are also defined between two slots f1, f2, and are used for an immobilization effect by locking an angular position of the internal receptacle relative to the insert 105.

FIGS. 21A-21B also illustrate a case in which the two slots delimiting the portion 6 are obtained by a notch f3 composed of several slots, for example by having a C or U shape. As illustrated in FIG. 21B, the insert 5 includes first locking means V1 on the side of the inner engagement face F5, to integrally secure the insert 5 to the internal receptacle 10. The first locking means V1 may be distributed selectively (and may consist) in the elastically deformable portions 6 that also include external lugs T for contact and/or friction with the neck 24, for instance below an inner step or inner shoulder 24*a* which is provided in the neck 24. In some options, except at such external lugs T, the insert 5 has no radial contact with the neck 24. The external lugs T may have opposite orientations to provide resistance against any rotation between the reservoir device DR and the external receptacle 20.

Alternatively, as illustrated in FIGS. 15 to 19, the insert 105 is a plastic part positioned similarly to the insert 5 of FIG. 1, with an overlap by the radial portion C of the top of the external receptacle 20, but having features for clamping and/or retaining the internal receptacle 10 which are located at least partly in the axial projection 5*c*, projecting upwards relative to the annular radial portion C. Thus, in such options, the inner engagement face F5 for engaging with the attachment region RF may be supplemented by an inner face F5', visible for example in FIG. 17A, provided with reliefs 7*a* preventing axial withdrawal of the internal receptacle 10. More generally, to oppose an axial withdrawal of the internal receptacle 10, such reliefs or coupling members may thus be located on an axial projection 5*c* which protrudes upwards as illustrated for example in FIGS. 17A, 17B and 18B, or on an insertion portion 5*a* which is descending relative to the radial portion C, as illustrated in the non-limiting case of FIG. 10.

Figure 17A:
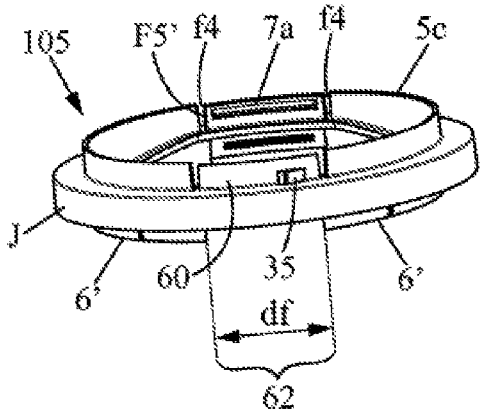
FIGS. 17A, 17B, and 17C show a perspective view of the insert of the container of FIG. 15, respectively in a side view, top view, and bottom view.
Figure 17B:
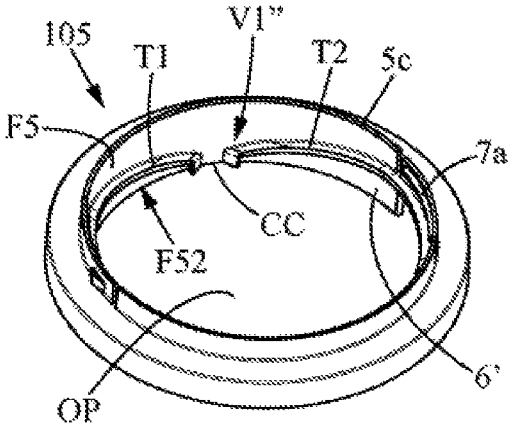
Figure 17C:
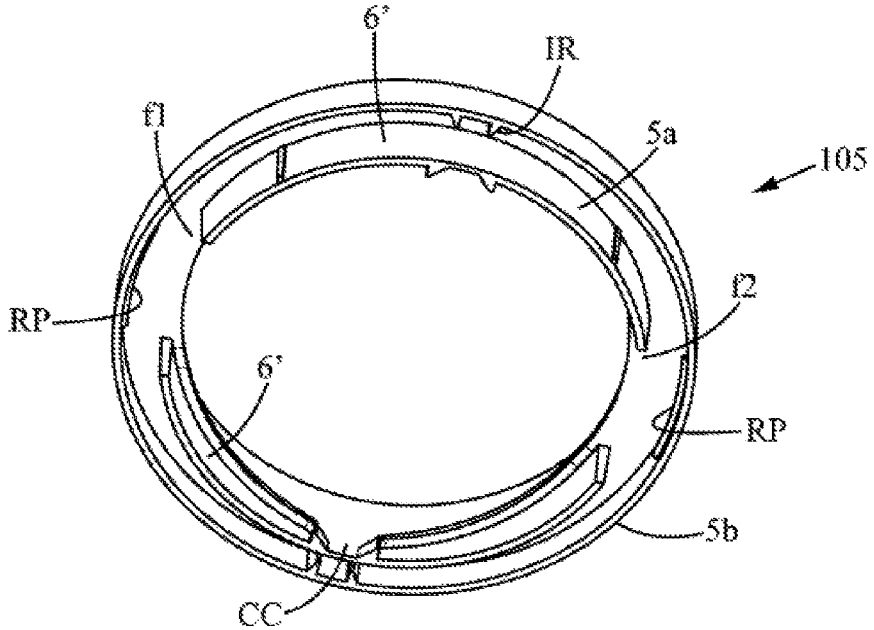

In some embodiments, for example such as in FIG. 17C, portions or tabs 60 are provided in the axial projection 5*c* of the insert 105 which are defined between two slots f4, these portions 60 bearing the reliefs 7*a* preventing axial withdrawal of the internal receptacle 10. The reliefs 7*a* are internal reliefs, optionally elongated (here by extending parallel to the plane of the radial portion C) to represent more than 50%, preferably more than 70%, of the widthwise extent of the corresponding portion 60. The slots f4 render the tabs 60 elastically deformable, enabling radial deflection for the insertion of the bead B10 or other anchoring member formed in the internal receptacle 10, in the attachment region RF.

The portions or tabs 60 may each further include at least one of the travel-arresting reliefs 35 which the reliefs N30 carried by the lid 30 come to rest against when the lid rotates to reaches its final lowered position where it covers the insert 105. In FIG. 19, one can see that each of the reliefs N30 has a longitudinal extension, for example parallel to the X axis in the assembled state. Each relief N30 may have an angled connection/join to a relief R30 for guiding the lid 30 in rotation. Of course, the lid 30 may also be locked in position by other means, possibly by being coupled by a bayonet system, preferably using reliefs on the edge of the flange 10*c*.

Slots f1, f2 may also be provided in an insertion portion 5*a* of the insert 105, in order to obtain elastic deformability, rendering elastically deformable each portion 6' and/or a part adjacent to these slots f1, f2. Such portions 6' of the insert 105 may optionally also carry some or all of the locking members V1" which allow locking/immobilizing the insert 105 on the internal receptacle 10. In the case of guiding the rotation of the internal receptacle 10 by internal reliefs or ramps T1, T2 of the insert 105, these reliefs may then be placed, at least in part, higher than the radial portion C.

Here, the internal receptacle 10 and the external receptacle 20 have a circular cross-section, in any cross-sectional plane perpendicular to axes X and X', these axes typically being coincident. This geometry facilitates the integral attachment between the receptacles 10, 20 by means of the insert 5, 5', 105 by a combination of a longitudinal insertion movement and a rotation to allow locking them rotationally, preferably by removable securing means allowing disassembly of the external receptacle 20.

Figure 2:
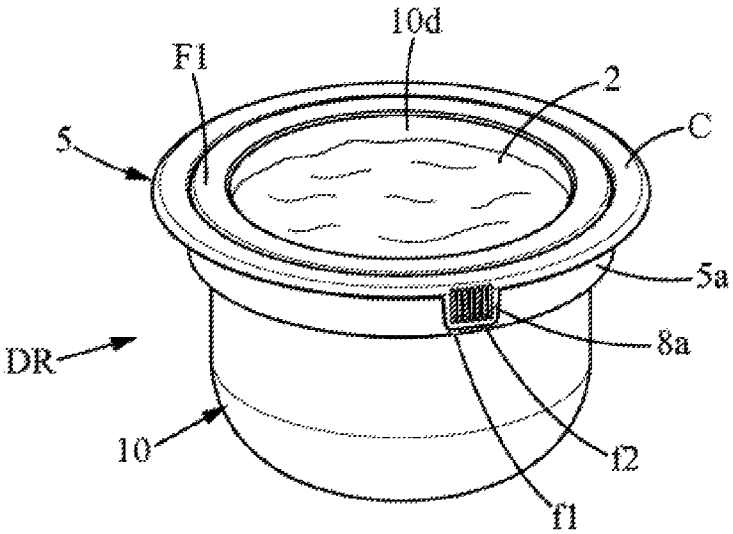
FIG. 2 is a perspective view showing the insert and the internal receptacle of FIG. 1 in a coupling state.

More particularly, with reference to FIGS. 1-2 and 7, the insert 5 may be mounted beforehand on the internal receptacle 10 by screwing while sliding it up from below until it reaches the annular region RF and then performing a relative rotation between the insert 5 and the internal receptacle 10. For example, the insert 5 may be rotated in a first direction, here a counterclockwise direction for a fixed upright vertical position of the internal receptacle 10.

Regarding the insert 105 of the embodiment shown in particular in FIGS. 17A, 17B and 17C, it is for example provided to couple it beforehand to the external receptacle 20, here with a rotational locking enabled by one or more insertion members IR which fit into notches or receiving areas 28' of the neck 24 which are axially open at their top. The structure of the neck 24 may be as illustrated in FIG. 19, for example without outwardly protruding reliefs apart from the rim 24*r* of generally annular shape, in which the receiving areas 28' are locally formed (shaped as notches/grooves here). The rim 24*r* may for example be composed of two engagement edges, separated from each other by these notches/grooves or receiving areas 28'.

Lugs or retaining elements RP projecting radially inwards from the inner side face of an outer skirt J or tongues of the outer portion 5*b*, also make it possible to prevent any upward movement of the insert 105, by coming to engage under the rim(s) 24*r*. Next, the internal receptacle 10 can be fixed to the insert 105 with a movement selected among screwing, a quarter turn, or a guided rotation, to reach a final low position of occupying an insertion channel CC (case with a receptacle 10 fitted with key(s) or similar reliefs 4'). The insertion channel typically separates two lower ends of a pair of ramps converging towards this insertion channel.

The retaining elements RP and the insertion members IR form means V2" of locking the position of the insert 105 on the external receptacle 20. Here, the areas of cooperation with these locking means V2' are distributed in different angular areas: under the rim 24*c* of the external receptacle 20 (where the retaining elements engage under this rim 24*c*) for retention preventing axial upward movement, and in the indentations or external notches of this rim 24*c* (where the insertion members IR are axially inserted) for a rotation-preventing effect.

Referring to FIG. 17A, the insert 105, which may be of generally circular shape around the opening OP, may have relatively wide slots f1, f2 as can be seen in particular in FIG. 17A. The width df of each of these slots f1, f2 here corresponds substantially to the width of the elastically deformable tab 60 formed between a pair of slots f4. In other words, this width df may be substantially equal to the spacing between the two slots f4 defining a tab 60. This arrangement improves the flexibility of each tab 60 by creating a hinge effect at the transition/connection between this longitudinally extending tab 60 and the corresponding segment 62 of the radial portion C. The two slots f1, f2 are for example distributed diametrically opposite each other on the circumference of the insert 105. The width df can represent a significant interruption in the insertion portion 5*a*, corresponding for example to a sector angle of between 15 and 55 degrees, preferably between 25 and 45 degrees.

Referring to FIG. 1, the coupling reliefs 4 include a thread provided with a notch or indentation, for example longitudinally traversing the protruding relief of the thread, in order to locally form a notch 14 capable of retaining a complementary protruding lug 15 provided in an inner engagement face F5 of the annular insert 5. Typically, two notches 14 or similar reliefs are provided, for example diametrically opposed, on the peripheral region RF. It is thus possible to obtain rotational locking linked to the retention of the lug 15 in the notch 14. Use may also be made of stop elements in the form of inwardly projecting reliefs, cooperating in this case with notches or similar relief portions provided in the inner engagement face F5. When the coupling reliefs 4 form a threaded area, a complementary screw thread or complementary guide/coupling members 7*a* are provided on the inner engagement face F5.

In non-limiting options corresponding to a preferred embodiment, several elastically deformable portions 6 may be formed, for example at least two in number. In certain variants, it is possible to limit this to a single elastically deformable locking member.

It is permitted to form locking means V1 which include, for example, a pair of locking tongues 56 which constitute the deformable portions 6. These tongues 56 each have two longitudinal sides, one defined by longitudinal slot f1 and the other by longitudinal slot f2 which here is parallel to slot f2. It is optionally possible to form a hinge area 19 at the base of the locking tongue 56, to allow deflection around this hinge area 19. In certain options, this type of slots f1, f2 may correspond to a pair of indented areas or slot segments which extend each other and/or join together, these areas being located for example within the same notch (for example an inverted U- or V-shaped notch).

Figure 13A:
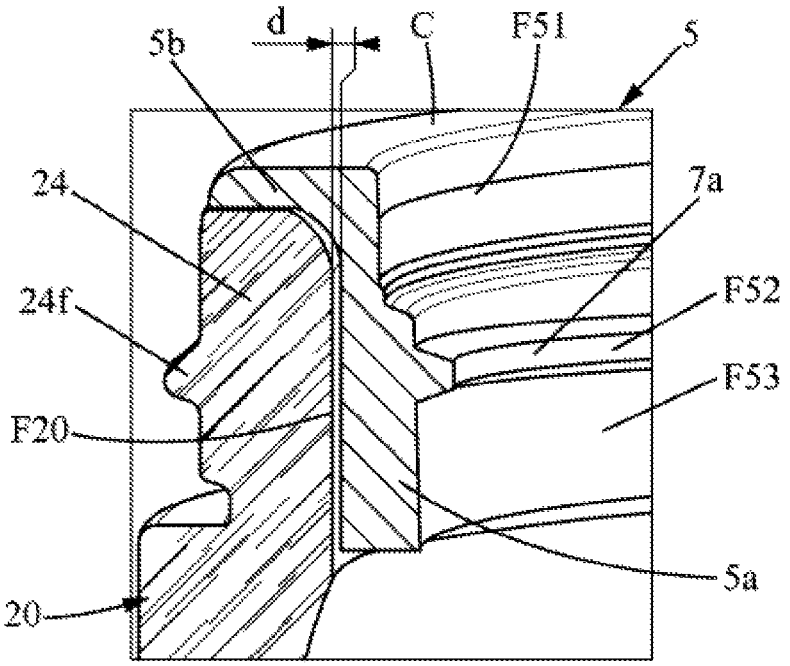
FIG. 13A illustrates a radial gap between the insertion portion of the insert and the side face opposite the lid-receiving member or neck of the external receptacle.
Figure 13B:
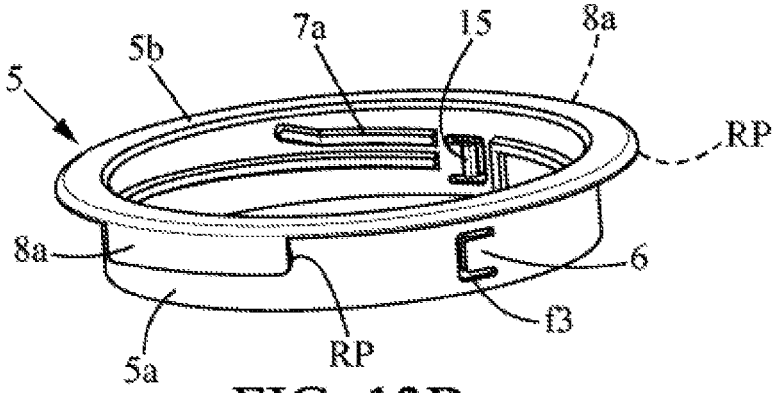
FIG. 13B shows an option for implementing an insert, suitable for rotational coupling to the internal receptacle while being compatible with elastically fitting onto the neck of the external receptacle.

As illustrated in FIG. 13A in particular, the tongue 56 or similar deformable portion 6 may advantageously be spaced apart from the glass inner face F20 formed facing the insertion portion 5*a* by the external receptacle 20. The radial spacing may correspond to a distance d which is at least equal to 1 mm, and preferably between 1 and 2 mm, in a locking configuration of the locking means V1. FIG. 5 shows the radial spacing d5 which exists between the tabs 8*a*, 8*b* and the insertion portion 5*a*, which is greater than the thickness of the neck 24, in order to create sufficient radial spacing to allow outward deflection of the tongue 56 when the insert 5 is in the state of being coupled on the internal receptacle 10. The coupling reliefs 4, 4' formed in the attachment region RF here preferably have a guiding function for a relative rotational coupling between the internal receptacle 10 and the inside of the insert 5, 5', or 105. Disassembly proves advantageous when having this type of rotational coupling, associated where appropriate with elastically deformable portions/tabs, because unlocking can correspond to exerting a relatively weak force compared to the force required to achieve axial unclipping, and without the use of protruding release tabs which interfere with obtaining a sleek external shape.

Referring to FIGS. 1, 15 and 20 to 21B, the coupling reliefs 4, 4' involved in the rotational coupling between the internal receptacle 10 and the insert 5, 105 allow:

- maintaining an assembled state of the reservoir device DR when mounting this latter inside the external receptacle 20, and
- easy (selective) removal of the insert 5, 105 once the reservoir device DR has been detached from the external receptacle 20, by simple rotating action.

Description of a Non-Limiting Example of Assembly

Successive steps of a method of assembling the container 1 will now be described, in particular with reference to FIGS. 1-2, 6, 9-10, 12-14, and 17C to 19.

The internal receptacle 10 and the insert 5 are first assembled using the opening OP delimited by the insert 5 to pass the body of the internal receptacle 10 through this opening OP, before moving the insert 5 closer to the flange 10*c* (from underneath) or other annular end E. The insert 5 is then rotationally engaged on the guiding elements/screw thread of the coupling reliefs 4, at the attachment region RF, by the insertion portion 5*a* of this insert 5. Ribs, threads, or similar guiding/coupling members 7*a* are formed on the inner face F5, selectively in the rigid portions 7 which here have an arcuate shape when viewed in cross-section. These portions 7 supplement the elastically deformable portions 6.

Referring to FIGS. 1, 10 and 14 or 15, 18A and 19, one can see that the insert 5, 105 is typically mounted selectively, from below relative to the flange 10*c*, on the attachment region RF. As can be seen in FIGS. 10 and 13 or 17B, it is understood that the attachment region RF may be guided by an annular area F52, formed internally on the insertion portion 5*a*. This annular area F52, continuous or discontinuous, is a coupling area having an immobilizing effect, here by means of inwardly projecting reliefs and ribs.

In the option of FIGS. 17A, 17B, and 17C, the insert 105 has an inner face F5 provided with ramps T1, T2 (projecting radially inward on this inner face F5) descending towards a channel, typically narrow, for immobilizing keys or similar protruding reliefs 4' formed on the outside of the side wall of the internal receptacle 10. For example, the ramps T1, T2 are divided into one or more pairs, here two pairs, of ramps T1, T2 which descend while converging towards an insertion channel CC for the insertion of a key or relief 4' inserted longitudinally (by simple sliding in the example shown), of the internal receptacle 10. The relief 4' is guided by one of the ramps T1, T2 and forms a means of indexing the internal receptacle 10 in rotation relative to the insert 105. Typically, only two positions, which are for example symmetrical, are possible when two reliefs 4' are provided. Alternatively, the number of reliefs 4' may be different from two and/or may correspond to only one indexing position.

More generally, it is understood that the annular area F52 may take many different shapes for guiding a relative rotational coupling between the insert 5, 105 and the internal receptacle 10. Locking, provided at the end of the guidance to avoid rotation opposite to the rotation which enabled obtaining the coupling state, is made possible by an indentation, a notch 14, or an insertion channel CC, provided on one among the annular area F52 and the attachment region RF.

In the first illustrated embodiment, this coupling area F52 may extend above a lower annular area F53, for example devoid of reliefs and forming lower free edges of portions 6 and 7 of the insertion portion 5*a*, as seen in FIG. 13A. Above the coupling area F52, there is also provided an annular transition portion between the outer portion 5*b* and the insertion portion 5*a*. This annular transition portion defines an area F51 of progressively reducing thickness, with the knowledge that the thickness decreases from bottom to top of the annular transition portion, until a minimum thickness is reached in a region distant from the radial portion C and provided to surround a flange 10*c* of the internal receptacle, before it then increases from bottom to top to join the radial portion C. Optionally, a surface S5 is provided at the bottom of the area F51 on which can rest the flange 10*c* or protrusions provided in the annular end E of the internal receptacle 10.

More generally, this type of thickness profile makes it possible to combine overall rigidity with elastic deformation effects, here for example for the lug 15 of the locking means V1, V1' to move past the coupling reliefs 4 (rigid, made of glass) and obtain locking without impacting the integrity of the insert 5, 5'.

In variant embodiments, it is also possible to provide notches or slots in the annular transition portion adjacent to the radial portion C. FIG. 3 shows, for example, an alternating distribution of transverse notches to form this type of area F51. More generally, it is understood that a reduction in thickness/removal of material, in particular above the portions 6 defined by two longitudinal slots f1, f2, facilitates the elastic deformation effect by locally defining a hinge area 19.

The coupling state of the insert 5, 105 around the internal receptacle 10 results from a relative rotation between the insert and the internal receptacle 10, reaching a locking configuration in which two sets of internal reliefs of the insert 5, 105 are engaged on the attachment region RF in order to:

prevent the internal receptacle 10 from moving upward;
lock the rotational movement.

As can clearly be seen in the figures, and in 15, 17A-17B in particular, the set of interior reliefs 7*a* (or possibly the single relief) for the upward movement-preventing effect is typically arranged higher than the other set of interior reliefs 15 or T1, T2 provided for locking rotational movement.

Referring to FIG. 19, it is understood that the external receptacle 20 may either first receive the insert 105 alone or receive the insert 105 already coupled with the internal receptacle 10 which itself may optionally already be provided with its lid for hermetically sealing the opening 10*d*. Regardless of the exact order of assembly, the container 1 obtained can offer easy disassembly of the internal receptacle 10 from the insert 105 (and from the entire reusable part).

Here, the elastically deformable tabs 60 are easy to move apart, with a slope configuration at the contact interface between the bead B10 and the interior reliefs 7*a*, which makes it possible to move the interior reliefs 7*a* away from these tabs 60 in response to a tensile force exerted from the top of the internal receptacle 10 (force which may be equivalent to or slightly greater than that exerted at the time of assembly), with knowledge that the flange 10*c* already forms a graspable region. More generally, the insert 105 is configured so that the withdrawal force required to disengage the interior reliefs 7*a* is less than the force required to disengage the retaining elements RP formed on an outer skirt J of the insert 105, which is more rigid than the tabs 60.

Figure 16:
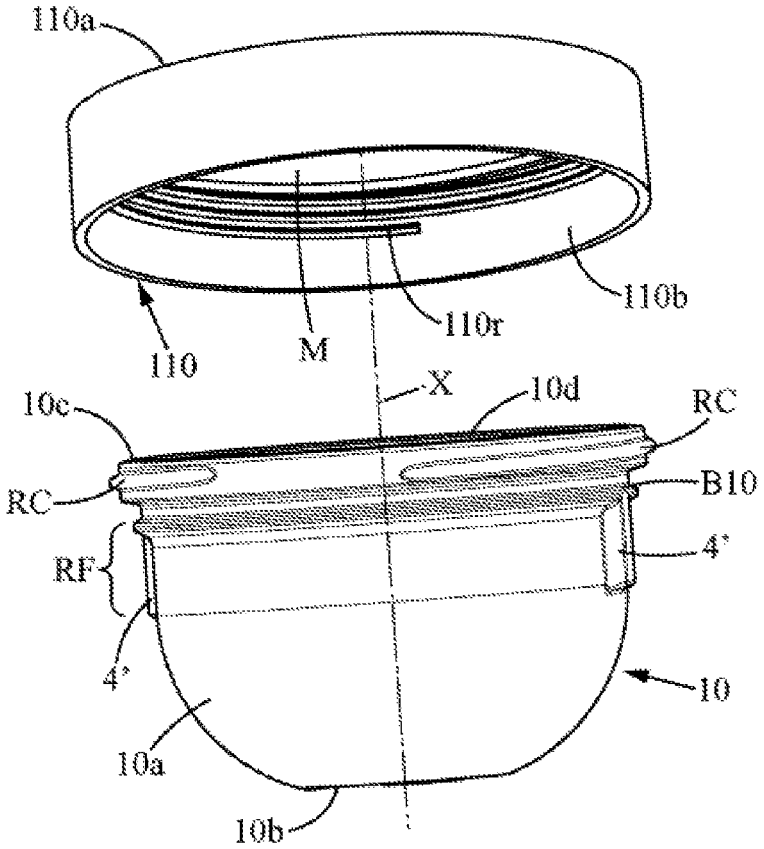
FIG. 16 illustrates an internal receptacle having different types of reliefs formed laterally under and on its flange, and capable of cooperating with a lid to form a refill unit/unit that is extractable from a receiving assembly consisting of the insert and the external receptacle of FIG. 15.

To facilitate this type of tensile force, at the time of an operation to replace the internal receptacle (refill), the lid 110 shown in FIG. 16 can first be screwed onto the internal receptacle 10 to be removed, by means of reliefs RC formed on the flange 10*c*. An upward pull (relative pull in relation to the reusable portion) with the user grasping this lid 110 with one hand while holding the external receptacle 20 with the other hand, allows easily detaching the internal receptacle 10.

Referring to FIG. 16, the lid 110 may be more compact than the main lid 30 by having a smaller height. Lid 110 has a bottom 110*a* and a side wall 110*b* which extends longitudinally downward from the bottom 110*a*. This lid 110 may be provided with a refill cartridge consisting of a replacement internal receptacle, typically in the form of a part made of glass (preferably thick glass). An inner membrane M, similar added layer, face integrated within the material of the lid, an annular inner sealing skirt or lip may further be provided at the bottom 110*a*, to ensure the hermetic closure of the internal receptacle 10 within the cartridge. Optionally, the refilling operation may consist of successively carrying out the following:

unscrewing the lid 110 supplied with the cartridge, in order to separate this lid 110 from the replacement internal receptacle;

screwing this lid 110 onto the internal receptacle 10 to be removed (the latter still being in its state of coupled with the insert 105), after having removed lid 30 from the container 1, the screwing of lid 110 being made possible by a screw thread 110*r* and/or suitable reliefs formed internally in the side wall 110*b* of lid 110;

removing, together, lid 110 and the internal receptacle 10, by pulling on lid 110 so as to enable the disengagement of the internal reliefs 7*a* formed in the elastically deformable tabs 60 of the insert 105 (with mobility via radial deflection of these tabs 60 in the knowledge that there is no lateral overlap of the tabs 60 by lid 110, unlike lid 30), relative to the bead B10;

placing the replacement internal receptacle within the inside volume V of the external receptacle 20, by insertion through the annular insert 105, typically by inserting the keys or similar reliefs 4' of the attachment region RF into the insertion channels CC, with simultaneous engagement of the bead B10 or other type of relief of the attachment region RF under the interior reliefs 7*a* with the effect of preventing accidental upward movement of the replacement internal receptacle 10.

It is understood that the replacement receptacle is typically identical to the internal receptacle 10 replaced, or at least similar, and is provided with the same reliefs made of glass in the attachment region RF.

It is thus possible to restore the container 1 with replenished content by removing only one recyclable glass part, constituting the internal receptacle. Of course, the lid 30 is kept in order to close the new internal receptacle 10 by covering the insert 105.

Referring to FIG. 18A, the lid 30 may have adaptable parts, for example in the form of an upper decorative plate 30*d* welded or attached to the structure forming the bottom 30*a* of the lid, on the outer side, opposite the contact layer or membrane seal 50 which may also be attached to the rigid structure forming the bottom 30*a*. Furthermore, the side wall 30*b* of the lid 30, here annular in shape to hide the outer portion of the internal receptacle 10 and all or part of the insert 105, has:

an inner face F30 for attachment to the flange 10*c* of the internal receptacle 10, as is clearly visible in FIGS. 15 and 19, this inner face being annular, defining a first inside diameter of the lid (which may be identical to the inside diameter of lid 110); and another annular inner face F30', covering the neck 24 of the external receptacle 20.

With reference to FIG. 19, an inner shoulder 30*e* provided in the wall 30*b* may separate these inner faces F30, F30', inner face F30' (lower) having an inside diameter which:

is greater than that of the outer face F30 (higher):

and/or corresponds to a maximum inside diameter of the lid 30.

Here, the transition in cross-section between these faces F30, F30' is achieved by a shoulder. In variants, the transition in cross-section is progressive. The inside diameter of the inner face F30' may optionally be substantially equal to an inside diameter of the external receptacle 20 measured under the shoulder 20*e*.

In a non-limiting manner, the material of the lid 30 may be of plastic, optionally partially of plastic by combining an inner portion of plastic and an outer portion of another material (optionally glass, ceramic, wood, metallic material, possibly another plastic or a composite material) which is different or of different stiffness than the material used to form the inner portion.

In the example illustrated in FIGS. 15 to 19, the internal receptacle 10 has a flange 10*c* which is atop the attachment region RF and comprises another area with relief(s). Here, in this other area formed on the edge (side face) of the flange 10*c*, flange reliefs RC are provided which project outward, forming means of rotationally coupling by engaging with complementary members R30, 110*r* formed internally within lid 30 and/or lid 110. This arrangement makes it possible to create the lid-attachment area higher than the insert 105, by simplifying the structure of the neck 24 and limiting the extension in height of the neck 24.

Referring again to FIG. 14, after the assembly step reflected by the transition from the separated state (A) to the coupling state (B) in FIG. 14, the internal receptacle can be filled 10 with the product 2 then a membrane seal 50 can be welded on to seal the opening 10*d* of the internal receptacle 10*d*. The transition from states (C) to (D) illustrates this sealing step, for example making it possible to fix the membrane seal 50 by an annular attachment area in contact with one among the outer portion 5*b* (at the top of a radial portion C visible in FIG. 6) of the insert 5 and/or the upper face F1 of the internal receptacle 10. A reservoir device DR is thus obtained (see FIG. 2), which can be considered a cartridge of the container 1.

Figure 14:
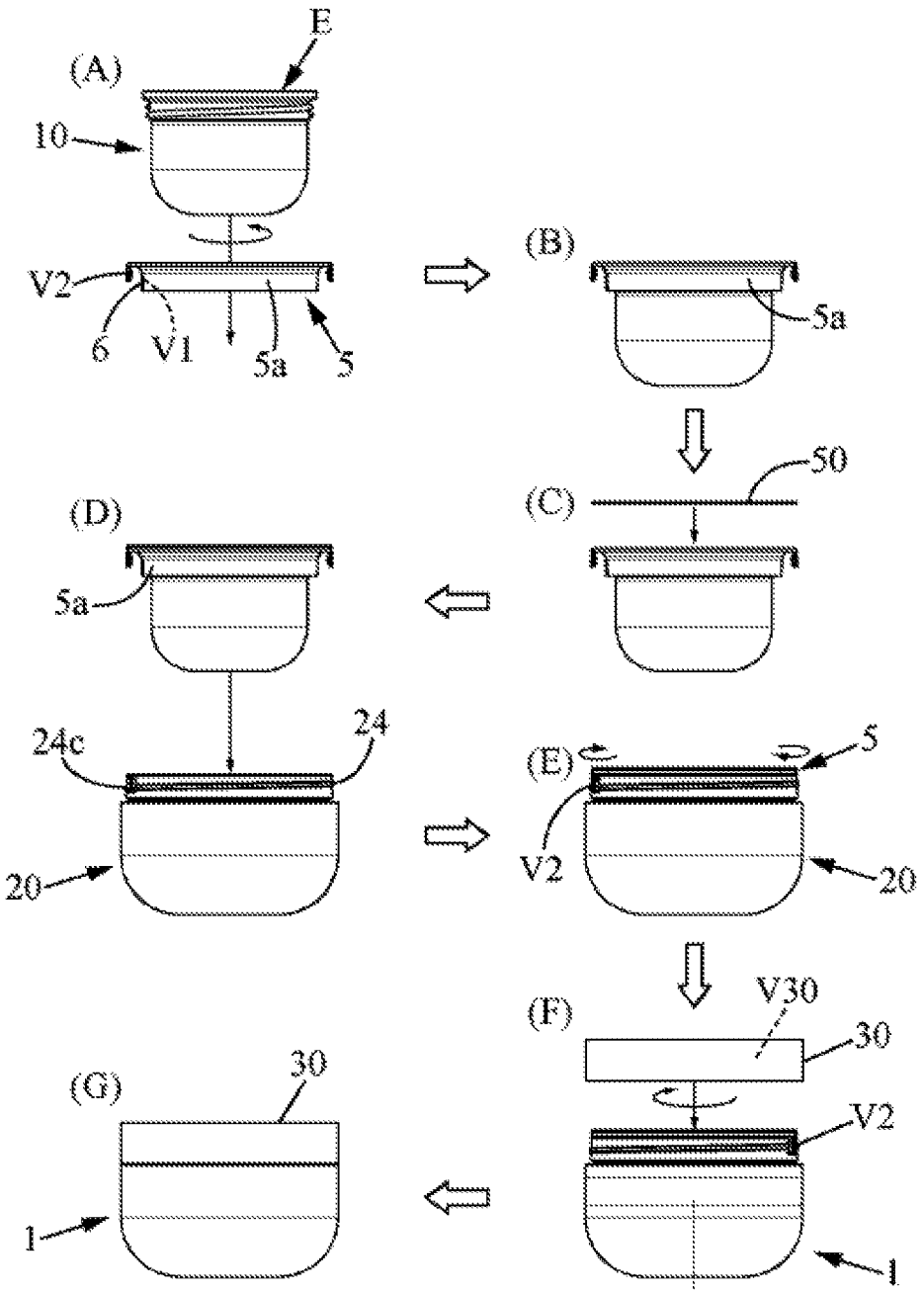
FIG. 14 illustrates the steps of the assembly process (omitting the addition of product which must be done before sealing with a membrane seal) to obtain the container closed by a lid, detailing the evolution for obtaining a refill then reaching the assembled state of the container as shown in FIG. 12 and the final step of closing the container by using an annular attachment area formed by the neck or receiving member, which includes sub-areas enabling a detachable securing of the insert.

With reference to FIGS. 6 and 14, the immobilization cavities C5 may be used to receive the upper portion of the external receptacle 20 in state (E), after having completely inserted the body (10*a*, 10*b*) of the internal receptacle 10 into the inside volume V of the external receptacle 20 (see step (D)). A small rotational movement is then sufficient to rotationally lock the coupling of external receptacle (20)—insert (5).

Before the operation (F) of putting on the lid 30, a bayonet-type attachment is implemented by causing rotation of the reservoir device DR inside the external receptacle 20, such that the engagement members, here formed by the tongues 8*a*, 8*b*, enter the locking area of the recesses 24*c* (on the left towards longitudinal edge BC1 in the case of the recess 24*c* visible in FIG. 12). State (G) corresponds to an example of a container 1 of the membrane-sealed type and provided with the lid 30 to cover the neck 24.

FIG. 12 shows the position of a tongue 8*a* in the locking position, which has been moved by pressing on the actuating member or surface 80 externally accessible on the side of the neck 24. Each tongue 8*a* and 8*b* is operable by inward radial pressure and their rotational movement is respectively permitted in one direction or the other when these tongues are placed in the recesses 24*c* through the upper axial opening 28.

This type of rotational actuation of the insert 5 is easy and makes it possible to overcome the resistance to unlocking. In the non-limiting examples illustrated, the bayonet-type attachment of the insert 5 is permitted by a manual action selectively carried out on two opposite sides of the outer side face of the neck. The final coupling of insert—external receptacle is permitted by cooperation between reliefs made of glass (23, GR) provided in the recesses 24*c* for receiving the graspable tabs 8*a*, 8*b*, typically in the absence of other manual actuation members: therefore there is no added bulk related to the graspable portions of the insert which would be located higher or lower than the neck 24. In addition, the radial portion C can be perfectly flat.

Here, there is provided in the recess 24*c* a snap-in relief or any suitable engagement edge GR, here of the vertical "grain of rice" rib type as can be seen in FIG. 7-8, which projects radially outward. In step (D) of FIG. 14, each member or lug 5*f* provided internally on the tab 8*a*, 8*b* can sit atop the rib or engagement edge GR, and a snap-fit can be obtained. In this manner, the cavities C5 shown in FIG.

6 constitute cavities for rotationally immobilizing the neck 24 or similar organ/ring of the external receptacle 20.

Alternatively, step (A) is optionally replaced by a step of mounting the insert 105 on the external receptacle 20, while the membrane seal 50 is fixed directly on the flange 10*c*. More generally, when the internal receptacle 10 allows attachment of the lid 30, this makes it possible to delay the coupling of the insert—internal receptacle, which can be a last assembly step when the insert 105 has already been attached to the external receptacle 20.

Rotational coupling is a preferred option to allow a locking effect at the end of a rotational movement of the internal receptacle 10 relative to the external receptacle 20.

In a variant with the insert 5' shown in FIGS. 3 and 4, it is understood that the rotational locking steps may be eliminated (no rotational guidance required to raise the insert 5' towards the annular end E), except possibly where the coupling to the external receptacle 20 is concerned, when the neck 24 of the latter can allow locking by rotation, in the manner of a bayonet connection, during engagement of the engagement members 8*c* on this neck 24.

Also, according to other embodiments, the insert 5 (already coupled to the internal receptacle 10 to form the reservoir device DR) may simply be snapped inside the external receptacle 20, possibly without second rotation locking means and/or without any insert outer portion covering the neck uppermost surface.

With reference to FIGS. 11 and 12, we will now describe certain features of a container 1 after the two couplings are obtained (in state (E) shown in FIG. 14). These features can also apply to the container 1 covered by lid 30, as illustrated in FIGS. 15 and 18A in particular, or FIG. 20.

In the examples illustrated, the section is generally circular for the insert 5, 5', or 105, and the external receptacle 20, at least in the area of contact with the insert. The internal receptacle 10 is also of circular section in its reservoir portion and at the attachment region RF. However, the receptacles 10 and 20 may have other geometries, in particular at a distance from their respective circular opening.

The insert 5, 105 may also have a geometry suitable for presenting an inner circumference having angles or protuberances to oppose rotation. In particular, the elastically deformable portions 6, 6' may delimit straight segments not having an arcuate profile, in certain options. The plane P5 defined by the top of the outer portion 5*b* of the insert 5 may be at the same level or higher relative to the level of the annular end E, which may be in the form of a flange 10*c* in some non-limiting examples. In other words, the insert 5 may not form a simple support sandwiched axially between a flange 10*c* of the internal receptacle and the upper face S2 of the external receptacle 20. In the case of FIGS. 11 and 12, on the contrary one can see that insert 5 (or alternatively insert 5') makes it possible to fully house and therefore harmoniously embed the internal receptacle 10 in the inside volume V of the external receptacle without upward axial protrusion beyond the annular end E relative to the insert 5. It is thus possible to limit the height of the container 1 if necessary.

It should be apparent to those skilled in the art that the invention allows embodiments in many other specific forms without departing from the scope of the invention as claimed. Thus, the material of the insert 5, 5', 105 can be adapted as needed, preferably by choosing a more rigid material than an elastomer. Furthermore, provision is made in the drawings for regular spacing between the receptacles 10, 20, without the possibility of contact against the inner face of the external receptacle 20. However, in certain options there is no reason not to have for example localized areas of axial contact or guidance.

In addition, options may also be provided with a bayonet attachment combined with a cam effect, for example by means of the slanted surfaces on the guide ribs 23, which can allow, at the time of decoupling by the second locking means V2, V2', the outer portion 5*b* to move slightly upward. This can facilitate the subsequent removal of the device DR forming the cartridge.

The invention claimed is:

1. A container for containing a product, formed by mounting, along a longitudinal axis, an internal receptacle within an external receptacle, using a coupling insert of annular shape, the container comprising:

the internal receptacle, made of glass, defining a volume for receiving the product and extending between a bottom and an upper face provided with an opening bordered by an annular upper end of the internal receptacle;

the external receptacle, made of glass, suitable for housing the internal receptacle internally within an inside volume accessible through a longitudinal opening defined by a neck or lid receiving member of the external receptacle; and the coupling insert, which is annular and integral with the internal receptacle, the coupling insert being suitable for directly supporting the annular upper end so as to create space between the internal receptacle and the external receptacle while maintaining the internal receptacle in a predetermined axial position relative to the external receptacle;

an annular peripheral attachment region being provided on the internal receptacle, at the annular upper end or in a downwardly offset position adjacent to the annular upper end, so as to engage an inner engagement face of the coupling insert with the annular peripheral attachment region and thus obtain a coupling state to immobilize the coupling insert on the internal receptacle, the external receptacle being suitable for internally receiving an insertion portion of the coupling insert which includes said inner engagement face, wherein the coupling state of the coupling insert around the internal receptacle results from a relative rotation between the coupling insert and the internal receptacle, to reach a locking configuration in which a lower portion of the coupling insert, constituting the insertion portion, is rotationally locked at or under the annular upper end, and wherein the insertion portion of the coupling insert has at least one elastically deformable portion which is:

suitable for engaging with the annular peripheral attachment region and locking the coupling state, and delimited by slots or indentations within the thickness of the insertion portion, wherein the insertion portion is annular, the coupling insert comprising:

first rotation locking members capable of being attached on the annular peripheral attachment region, opposing the rotation of the coupling insert around the internal receptacle in order to lock the coupling state, and each formed in the inner engagement face, in the at least one elastically deformable portion, each elastically deformable portion being separated from the rest of the insertion portion by slots, and second rotation locking members opposing the rotation of the external receptacle around the coupling insert, the second rotation locking members being configured to maintain an axial attachment position of the coupling insert, in which the insertion portion is inserted such that the internal receptacle is in said predetermined axial position which is fixed when the coupling state and the locking configuration are obtained.

2. The container of claim 1, wherein the internal receptacle has an upper flange to form the annular upper end, the upper flange extending around the opening, which is the only opening of the internal receptacle, and wherein the coupling insert is suitable for being mounting from below the upper flange of the internal receptacle.

3. The container of claim 1, wherein the insertion portion is a lower portion offset radially inward relative to said neck or receiving member, the second rotation locking members being formed in an outer upper portion distinct from the lower portion, by extending the insertion portion upward and/or outward.

4. The container of claim 1, wherein the second rotation locking members are formed in a portion of the coupling insert which is an outer portion distinct from the insertion portion and suitable for covering or wrapping a top of the external receptacle surrounding said longitudinal opening.

5. The container of claim 4, wherein said neck or receiving member has a screw thread for attachment of a lid provided with complementary threads, the screw thread being discontinuous and/or extending over less than 360° so that it does not interfere with areas or recesses for receiving from above engagement members that are part of the outer portion of the coupling insert.

6. The container of claim 5, wherein the neck or lid-receiving member, which is part of the external receptacle, extends around the annular upper end and has an outer side face provided with at least two recesses to allow a bayonet-type attachment of the coupling insert, by cooperation with the outer portion of the coupling insert.

7. The container of claim 6, wherein a bayonet-type attachment of the coupling insert is achieved by cooperation between reliefs made of glass provided in the recesses and the engagement members formed in said outer portion of the coupling insert, in a peripheral area extending around the longitudinal opening of the external receptacle, the engagement members being graspable members of the outer portion, wherein the coupling insert has no manual actuation members with the exception of the engagement members, the engagement members being operable by radially inward pressure and rotation in both directions when mounted in the recesses, such that the second rotation locking members allow locking by clamping or snap-fitting which is reversible without modifying the rotationally locked state between the coupling insert and the internal receptacle, as permitted by the first rotation locking members which are of the snap-fitting type, whereby the coupling insert and the internal receptacle form a unit detachable as one piece from the external receptacle.

8. The container of claim 7, wherein the engagement members formed in the said outer portion of the coupling insert are longitudinal tabs which, together with the insertion portion, delimit an immobilization cavity to house a portion of said neck or lid-receiving member, each of the longitudinal tabs facing a radially movable tongue provided in the insertion portion, which constitutes one of the elastically deformable portions defined between a pair of slots of said slots of the insertion portion, and which has an inward or protruding relief to engage with a corresponding protruding or inward relief formed in the annular peripheral attachment region.

9. The container of claim 6, wherein the bayonet-type attachment of the coupling insert is achieved by cooperation between reliefs made of glass provided in the recesses, and engagement members formed in said outer portion of the coupling insert, the engagement members being longitudinal tabs of the outer portion which together with the insertion portion define a cavity for immobilizing said neck or lid-receiving member, each of the recesses resulting from a local reduction in the thickness of the glass constituting the external receptacle and opening onto a top of the external receptacle to allow longitudinal insertion of one of the engagement members.

10. The container of claim 1, comprising an external lid engaged with the neck or receiving member, wherein a membrane seal for sealing the opening of the internal receptacle and the outer portion of the coupling insert extends entirely within an inside volume of the external lid, and wherein the second rotation locking members are provided between an outer side face of the neck or receiving member and a skirt of the external lid and are configured to allow subsequent disassembly of the coupling insert from the external receptacle with provision that the external lid has been removed.

11. The container of claim 1, wherein the external receptacle has an inner face made of glass, surrounding the insertion portion of the coupling insert which is made of plastic, the insertion portion extending annularly at a radial distance from the inner face made of glass.

12. The container of claim 11, wherein said first rotation locking members include locking tongues defined between a pair of slots among said slots of the insertion portion and allowing movement by deflection, each tongue being radially spaced apart from the inner face made of glass by a distance at least equal to 1 mm, in a locking configuration of the first rotation locking members.

13. The container of claim 1, wherein the second rotation locking members are configured to be attached to the external receptacle in a locking configuration without interfering with the coupling state, and wherein the second rotation locking members are formed in one or more regions of the coupling insert which are separate from the elastically deformable portion or portions.

14. The container of claim 1, wherein the coupling insert is made as one piece, of molded plastic.

15. A method of assembly for obtaining the container of claim 1, by mounting an internal receptacle made of glass into an external receptacle made of glass, the method comprising:

coupling of a coupling insert of annular shape around the internal receptacle, until a locking configuration is reached in which a lower portion of the coupling insert is rotationally locked at or under an annular upper end of the internal receptacle, by engagement of first rotation locking members, each formed in an inner engagement face of the lower portion, against reliefs of an annular peripheral attachment region of the internal receptacle, the first rotation locking members being provided in at least one elastically deformable portion separated from the rest of the lower portion by slots or indentations in the thickness;

hermetic sealing of an opening of the internal receptacle;

assembling by insertion of the internal receptacle, in a direction parallel to a longitudinal axis of the internal receptacle, into an inside volume of the external receptacle, through a longitudinal opening of the external receptacle defined by a neck or lid-receiving member, until the lower portion of the coupling insert coupled to the internal receptacle becomes an insertion portion inserted through the neck or receiving member, between face-to-face glass walls which are respectively part of the internal receptacle and the external receptacle; and integrally securing the coupling insert and said neck or receiving member by engaging, on engagement edges formed on this neck or receiving member, second rotation locking members formed in one or more regions of the coupling insert, in order to block relative rotation between the external receptacle and the coupling insert.

16. The method of claim 15, wherein the integral securing of the coupling insert to the neck or receiving member is carried out by pivoting the coupling insert relative to a longitudinal axis of the external receptacle, and constitutes an attachment that is detachable, such that a detachment is enabled in response to a reverse pivoting movement manually actuated on actuating members or surfaces which are part of the coupling insert and are provided on the outside of the external receptacle and included in the second locking members, the second rotation locking members being formed in an outer portion of the coupling insert which is distinct from the insertion portion, and wherein the pivoting of the coupling insert is carried out while maintaining a predetermined distance between the insertion portion and the neck or receiving member.

* * * * *